US006302393B1

(12) United States Patent
Beskitt et al.

(10) Patent No.: US 6,302,393 B1
(45) Date of Patent: Oct. 16, 2001

(54) MEDIA STORAGE SYSTEM FOR AUTOMATED BANKING MACHINE

(75) Inventors: William Daniel Beskitt, Cuyahoga Falls; Michael J. Harty, North Canton, both of OH (US)

(73) Assignee: Diebold, Incorporated, North Canton, OH (US)

( * ) Notice: Subject to any disclaimer, the term of this patent is extended or adjusted under 35 U.S.C. 154(b) by 0 days.

(21) Appl. No.: 09/390,930

(22) Filed: Sep. 7, 1999

Related U.S. Application Data

(60) Provisional application No. 60/100,758, filed on Sep. 17, 1998.

(51) Int. Cl.[7] ..... B65H 39/10; B65H 29/00

(52) U.S. Cl. ..... 271/385; 271/187; 271/315

(58) Field of Search ..... 271/305, 187, 271/315, 82, 83, 69, 70

(56) References Cited

U.S. PATENT DOCUMENTS

| | | | | |
|---|---|---|---|---|
| 4,511,133 | * | 4/1985 | Kokubo et al. | 271/315 |
| 5,476,256 | * | 12/1995 | Fortuna | 271/315 |
| 5,692,740 | * | 12/1997 | Holtje | 271/187 |

FOREIGN PATENT DOCUMENTS

| | | | | |
|---|---|---|---|---|
| 2168686 | * | 6/1986 | (GB) | 271/315 |
| 0037039 | * | 2/1988 | (JP) | 271/315 |
| 0051267 | * | 3/1988 | (JP) | 271/315 |
| WO93/24402 | * | 12/1993 | (WO) | 271/315 |

* cited by examiner

*Primary Examiner*—H. Grant Skaggs
(74) *Attorney, Agent, or Firm*—Ralph E. Jocke; Walker & Jocke

(57) ABSTRACT

A media storage system for an automated banking machine (10) includes a rotating flipper member (90, 178, 222) which is rotationally movable to engage sheets. A moveable gripper member (138, 182, 226) is movably mounted relative to the flipper member. The flipper member further includes an arcuately extending slot (92, 180, 232). A sheet extending in the slot is held in fixed engagement with the flipper member by the gripper member. Rotation of the flipper member to a releasing position causes the sheet to be engaged with a stop surface (160, 188, 284) as the gripper member moves to release the sheet. Sheets released by the flipper member are positioned in a stack (94, 184, 234). In alternative embodiments a flipper member (178, 222) includes a picker portion (202, 278). The picker portion is selectively operated to remove sheets from the stack for delivery to a user of the machine.

53 Claims, 29 Drawing Sheets

MEDIA STORAGE SYSTEM FOR AUTOMATED BANKING MACHINE

This application claims benefit of Prov. No. 60/100,758 filed Sept. 17, 1998.

TECHNICAL FIELD

This invention relates to automated banking machines. Specifically, this invention relates to an automated banking machine which includes an apparatus for storing sheets such as currency notes. Alternative forms of the invention also have the capability of selectively dispensing sheets that have been previously stored.

BACKGROUND ART

Automated banking machines are known in the prior art. A common type automated banking machine is an automated teller machine (ATM). Automated banking machines are commonly used to conduct transactions such as dispensing cash, making deposits, paying bills and receiving statements. Other types of automated banking machines are used by service providers such as retail clerks and bank tellers to obtain cash from a storage area. Other types of automated banking machines are used to dispense and receive checks, scrip, tickets, vouchers and coupons. For purposes of this disclosure an automated banking machine shall be considered to be any machine which performs transactions involving transfers of value.

Automated banking machines such as ATMs commonly dispense cash in the form of currency notes to a user from a supply within the machine. Provisions must be made in such machines to periodically replenish the cash which is dispensed. This often involves having an armored car service or similar personnel open the machine and replace the canisters which hold currency sheets or other sheets representative of value.

Some automated banking machines also accept deposits from customers. Commonly such deposits are accepted in envelopes. The deposited envelopes are marked with identifying indicia and stored in a secure enclosure within the machine. Periodically personnel open the machine, remove the deposit envelopes and verify that the amounts actually deposited correspond to the amounts indicated by users as being deposited in the machine. Again this process typically involves having the deposit envelopes removed by personnel under secure circumstances so that deposited funds are not lost or stolen.

Some types of currency recycling automated banking machines have been developed. In such machines currency deposited by one customer is identified and stored. The stored currency may then be retrieved from storage and provided to another customer who requests a withdrawal of cash from the machine. Currency recycling machines are not common in the United States due to difficulties associated with identifying and handling the sheets which comprise the U.S. currency bills. In addition current recycling machines generally have limitations associated with slow speeds, reliability and relatively high cost.

Thus there exists a need for a media storage system for automated banking machines that is more economical, and which operates at higher speeds with greater reliability. There further exists a need for a media storage system in an automated banking machine that enables both storing currency or other sheets in a storage area and dispensing sheets from the storage area so that sheets deposited into the machine by one user may be dispensed to another user.

DISCLOSURE OF INVENTION

It is an object of the present invention to provide an apparatus which stacks sheet media such as U.S. currency notes.

It is a further object of the present invention to provide an apparatus which stacks sheets reliably and at high speed.

It is a further object of the present invention to provide an apparatus which stacks sheets in a storage area and selectively dispenses sheets from the storage area.

It is a further object of the present invention to provide an apparatus which includes an automated banking machine which receives sheets and stacks the sheets therein.

It is a further object of the present invention to provide a currency recycling automated banking machine.

It is a further object of the present invention to provide a method for storing stacked sheets.

It is a further object of the present invention to provide a method for storing and dispensing stacked sheets.

It is a further object of the present invention to provide a method for storing sheets in a storage area and dispensing sheets from the storage area.

It is a further object of the present invention to provide a method for operating an automated banking machine.

Further objects of the present invention will be made apparent in the following Best Modes for Carrying Out Invention and the appended claims.

The foregoing objects are accomplished in exemplary embodiments of the present invention by an automated banking machine. The machine includes a frame which supports a plurality of devices therein. Among the devices in the machine is a sheet moving mechanism which is operative to move sheets along a sheet path.

A rotatable flipper member is mounted in the machine and is selectively rotated therein. The flipper member includes a peripherally extending slot which is sized to accept a sheet. In an engaging position of the flipper member the slot is positioned to engage a sheet moving in the sheet path.

A gripper member is movably mounted in supporting connection with the flipper member. The gripper member is movable relative to the slot between a first position and a second position. In the first position the gripper member is positioned to hold a sheet in the slot in relatively fixed engagement with the flipper member. In the second position the gripper member is positioned so that a sheet is enabled to move in the slot relative to the flipper member.

A stop surface is positioned adjacent to the flipper member such that a projection of the stop surface in a direction parallel to an axis of rotation of the flipper member intersects the slot when the flipper member is rotated to a releasing position. A moving mechanism is in operative connection with the flipper member and the gripper member. The moving mechanism is operative responsive to a controller in the machine to move the flipper member between engaging and the releasing positions as the gripper member moves between the first and second positions, respectively.

In operation a sheet moving in the sheet path engages the slot in the flipper member. The gripper member moves to engage and hold the sheet in relatively fixed engagement with the flipper member as the flipper member rotates towards the releasing position. As the flipper member reaches the releasing position the sheet engages the stop surface and is positioned in abutting relation therewith as the gripper member releases the sheet. As a result the sheet is deposited in a stack positioned against the stop surface. The flipper member continues to rotate until it is again in the engaging position adjacent the sheet path.

In alternative exemplary forms of the invention sheets are dispensable from the stack into the sheet path. In one form of the invention the gripper member includes a high friction segment which is selectively engageable with the first sheet in the stack. A stripping mechanism is provided to minimize the probability that more than one sheet is removed from the stack at any one time. A sheet removed from the stack is then directed into the sheet path.

The exemplary apparatus of the present invention is preferably used in an automated banking machine that accepts and stores sheets such as currency notes, checks or similar items of value, and stores them in at least one stack within the machine. Alternative exemplary forms of the invention include automated banking machines that provide recycling of sheets by accepting sheets from a user and then storing them in a stack. The sheets in the stack are then removed from the stack and dispensed to customers using the machine.

BEST MODES FOR CARRYING OUT INVENTION

Figure 1:
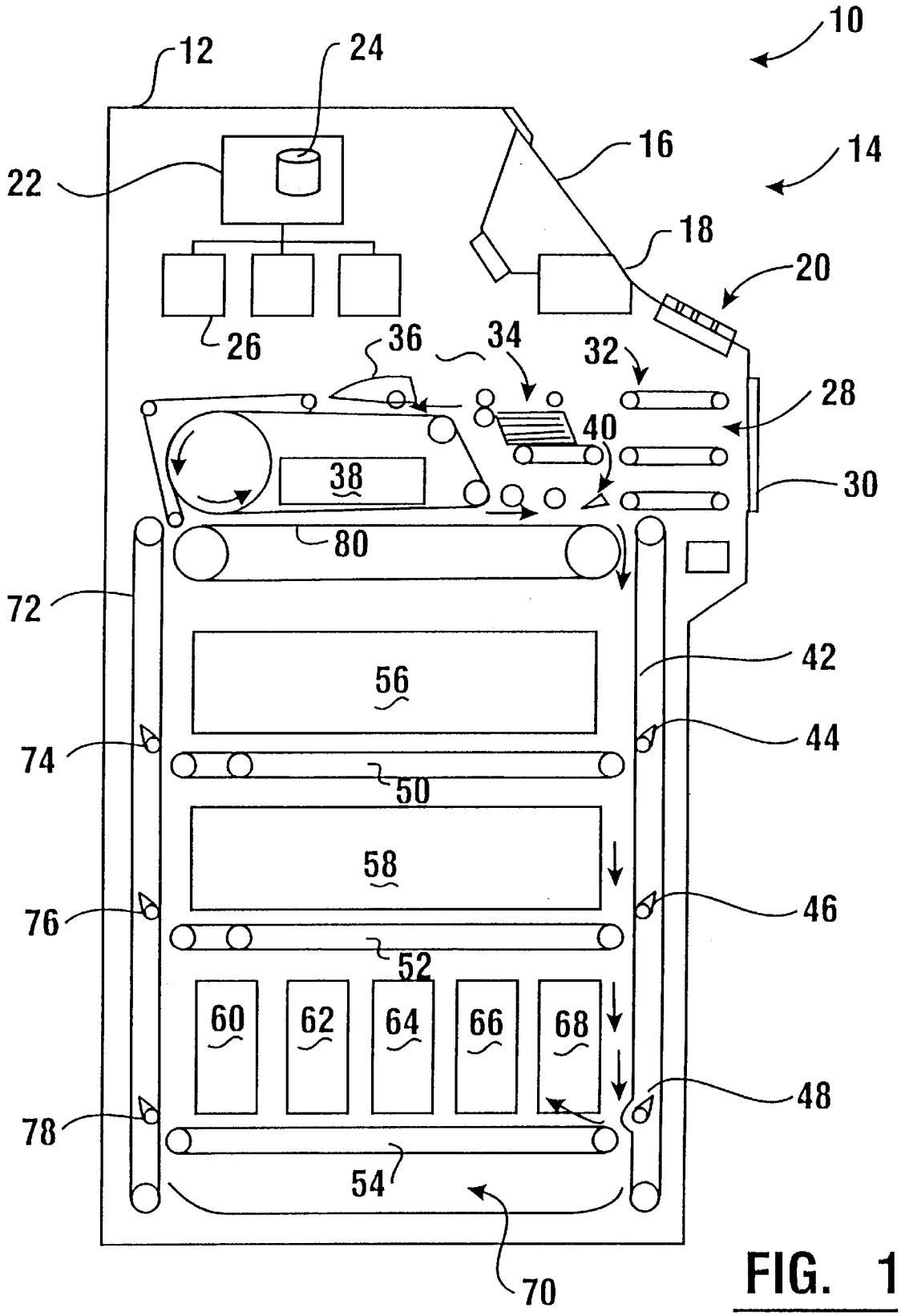
FIG. 1 is a schematic view of the components of an automated banking machine of an exemplary embodiment of the present invention.

Referring now to the drawings and particularly to FIG. 1 there is shown therein an automated banking machine generally indicated 10. In the embodiment shown the automated banking machine 10 is an automated teller machine (ATM) with currency recycling capability. Other types of automated banking machines may be used in connection with embodiments of the invention.

Machine 10 includes a frame schematically indicated 12. Frame 12 includes a housing for supporting components in and on the machine. It should be understood that frame 12 in various embodiments of the invention may include numerous supporting members, subframes and other components for supporting devices and mechanisms on and within the machine 10.

Machine 10 includes a customer interface area generally indicated 14. The customer interface area includes an output device 16. In the embodiment shown the output device 16 includes a screen such as a CRT or LCD screen. It should be understood that in other embodiments of the invention other types of output devices including touch screens, flat panel displays, speakers and other types of image or sound projection devices may be used.

Machine 10 also includes at least one input device. In the embodiment shown the input devices include a card reader schematically indicated 18. The card reader 18 is operative to receive a card or similar object from a user of the machine. The card generally contains indicia encoded thereon which may be used to identify the user. Card reader 18 may be for example a reader used for reading magnetic stripe cards, smart cards or other types of indicia.

Another type of input device on the machine includes a keypad 20. Keypad 20 in the embodiment shown may be used for inputting identifying information from the customer as well as instructions to the machine.

It should be understood that the input devices which include the card reader and the keypad are exemplary and in other embodiments other types of input devices may be used. For example other input devices may include biometric type reading devices for receiving inputs which identify a user. Likewise alternative machines may employ function keys or touch screen inputs for receiving instructions. Alternative forms of the invention may further include devices which recognize a user's voice and/or receive instructions by a voice input from a user. Numerous types of output and input devices may be employed as part of the customer interface area 14 depending on the performance requirements and capabilities of the automated banking machine.

The automated banking machine 10 further includes a controller schematically indicated 22. Controller 22 preferably includes one or more processors. The processors are in operative connection with a memory, which may comprise one or more data stores and is schematically indicated 24. Memory 24 includes programmed instructions as well as data used in operation of the machine. Controller 22 is in operative connection with the input and output devices through various interfaces (not shown). The controller is also in operative connection with a plurality of devices schematically indicated 26. Devices 26 preferably include numerous devices used in the machine for positioning or controlling various mechanical components. Such devices include drive motors, solenoid actuators, sheet guiding mechanisms, sheet moving mechanisms and other similar devices. Because of the numerous types of devices which generally perform such functions in the machine, such devices are shown schematically for simplicity. It should be understood however that the various mechanisms are distributed throughout the machine and are generally adjacent to the components which perform the associated functions.

The embodiment of the invention shown further includes an opening schematically indicated 28 in the customer interface area. Access to the opening is controlled by a movable gate member 30. In operation of the exemplary machine customers are enabled to insert and receive sheets from the machine through the opening 28 when the gate member is moved by the machine to an open condition. In the embodiment of the invention shown the sheets are generally received from and provided to users in the form of stacks. However in other embodiments individual sheets or other forms of collections of sheets may be received. When sheets are not being moved through the opening a device operates to close the gate. Other embodiments of the invention may include configurations where sheets are accepted for deposit into the machine on one side of the machine such as behind a wall or counter, and are dispensed to users on an opposite side. Alternative configurations may accept and dispense sheets in multiple locations.

The exemplary machine further includes an escrow and delivery mechanism schematically indicated 32. The escrow and delivery mechanism includes sheet moving mechanisms schematically shown which operate to receive stacks of sheets from users and move them in the machine. The escrow and delivery mechanism 32 is further operative to collect sheets therein and move them outward to a user through the opening 28. The escrow and delivery area may further operate to hold sheets on a temporary basis, as well as to segregate sheets of one type from sheets of another type during operation of the machine. Numerous functions may be provided by the escrow and delivery mechanism 32 depending on the nature of the machine and the programming thereof.

The exemplary embodiment of the automated banking machine 10 also includes an unstack mechanism 34. The unstack mechanism is operative to separate sheets from a stack and deliver them one at a time to other devices in the machine. The unstack mechanism 34 receives stacks of sheets from the escrow and delivery mechanism 32. Sheets separated from the stack are delivered to an aligning mechanism 36. In the preferred form of the invention the aligning mechanism is operative to center and angularly align sheets relative to the sheet path.

Sheets are moved within the exemplary automated banking machine 10 past a sheet identification mechanism schematically indicated 38. The sheet identification mechanism is operative to determine the particular type of sheet or note which is passed adjacent thereto. In one exemplary form of the invention the sheet identification mechanism includes a bank note denominator and validator of the type shown in U.S. patent application Serial No. 08/749,260 filed Nov. 15, 1996, now U.S. Pat. No. 5,923,413 the disclosure of which is incorporated herein by reference in its entirety as if fully rewritten herein.

Sheets that have been analyzed by the sheet identification mechanism are selectively directed responsive to the programming of the controller 22 by a diverter mechanism 40. The diverter mechanism 40 is operative to selectively direct each sheet to either areas within the escrow and delivery mechanism 32 or into connection with a first input sheet conveyor 42.

Input sheet conveyor 42 extends in the machine as schematically shown. Diverter gates 44, 46 and 48 extend adjacent to the input sheet conveyor and enable selectively directing sheets to sheet moving conveyors 50, 52 or 54. The sheet moving conveyors serve as sheet moving mechanisms for moving sheets adjacent to respective devices.

A recycling mechanism 56 which may be of one of the types later described in detail is positioned adjacent to sheet moving conveyor 50. Another recycling mechanism 58 is positioned adjacent to sheet moving conveyor 52. The recycling mechanisms 56 and 58 are selectively operative to receive sheets from the adjacent sheet moving conveyor and to store them therein, as well as to dispense sheets from storage and deliver them into the adjacent sheet moving conveyor.

A plurality of stacking mechanisms 60, 62, 64, 66 and 68 are positioned adjacent to sheet moving conveyor 54. As later described in detail each of the stacking mechanisms is selectively operative to receive sheets from the sheet moving conveyor 54 and to store sheets therein.

The embodiment of the automated banking machine 10 shown in FIG. 1 further includes a dump storage area schematically indicated 70. In the embodiment shown the dump storage area is used for storing sheets which are not to be recycled or stacked. The dump storage area 70 for example may be used for holding sheets which are determined to be counterfeit, sheets which are unidentifiable, or sheets which have been determined to be unsuitable for handling by the machine.

Machine 10 further includes an output sheet conveyor schematically indicated 72. Output sheet conveyor has positioned adjacent thereto diverter gates 74, 76 and 78. The diverter gates 74, 76 and 78 are selectively operative to direct sheets from the sheet moving conveyors 50, 52 and 54 respectively to the output sheet conveyor 72. Output sheet conveyor 72 is positioned adjacent to central conveyor 80 which is operative to move sheets past the sheet identification mechanism 38 and adjacent to the diverter mechanism 40. It should be understood that although in the embodiment shown the input sheet conveyor 42 is described as feeding sheets into various devices and the output sheet conveyor 72 is described as feeding sheets out of devices, the conveyors and diverter gates used for moving sheets in embodiments of the invention may be operative to move sheets in both directions. Sheet moving devices may have various forms and configurations depending on the requirements of the machine. It should further be understood that the devices shown in automated banking machine 10 are exemplary and other embodiments of the invention may include additional or other types of devices. Such devices may include for example bar code or magnetic character readers suitable for identifying checks or coupons. Other types of devices may include imaging devices for generating electronic images of checks or other instruments. Other types of devices may include printing devices for printing bank checks, travelers checks or other instruments within the machine.

The operation of the automated banking machine will now be described with respect to exemplary transactions. In the case of the transaction schematically represented by the conditions shown in FIG. 1, the transaction involves receiving a sheet from a user which will be stored by a stacking mechanism within the machine. Such a transaction may involve a note, coupon, check, voucher or other sheet which is received from a customer or other user and stored within the machine, but is not stored in a manner which enables it to be subsequently provided by the machine to another customer.

In this example the user of the machine operates the machine in accordance with instructions generated responsive to the controller 22 and which are output through the screen 16. The customer inputs data through the input devices 18 and 20 such as by insertion of a bank card to the card reader 18 and input of a PIN number through the keypad 20. The customer also operates an input device to request a transaction.

The controller 22 operates one of its operatively connected devices such as a modem or communications device to communicate with a remote host computer to verify the identity of the user as well as that the user is authorized to conduct the requested transaction. The programming of the controller is operative to generate appropriate messages to the host computer. The host computer is operative to return messages to the machine indicative of whether the customer is authorized to conduct the requested transaction.

Alternatively the programming associated with the controller 22 may be operative to determine independently whether or not the customer is authorized to operate the machine. This may be accomplished by the machine correlating the PIN and card data input by the user, or through alternative methods and processes in accordance with data stored in its memory. Machines of the invention may be operated in various types of ATM, point of sale or other types of transaction processing systems.

In the operation of the exemplary embodiment being described, it will be assumed that the user is authorized to operate the machine. The user inserts a plurality of sheets into the machine through the opening, which sheets are shown in FIG. 1 in the unstack area 34. The sheets are separated, moved through the aligning mechanism 36 and past the sheet identification mechanism 38 where the type of each sheet is identified. The programming of the controller 22 is operative to determine the appropriate routing for each sheet. For purposes of this exemplary transaction it will be presumed that the sheet identification mechanism 38 has identified a particular sheet as one that the controller determines should be directed to stacking mechanism 68. In this case the diverter mechanism 40 directs the sheet to the input sheet conveyor 42. The controller further actuates diverter gate 48 and runs sheet moving conveyor 54. Sheet moving conveyor 54 receives the sheet and serves as a sheet moving mechanism for moving the sheet to the appropriate sheet stacking mechanism.

Figure 2:
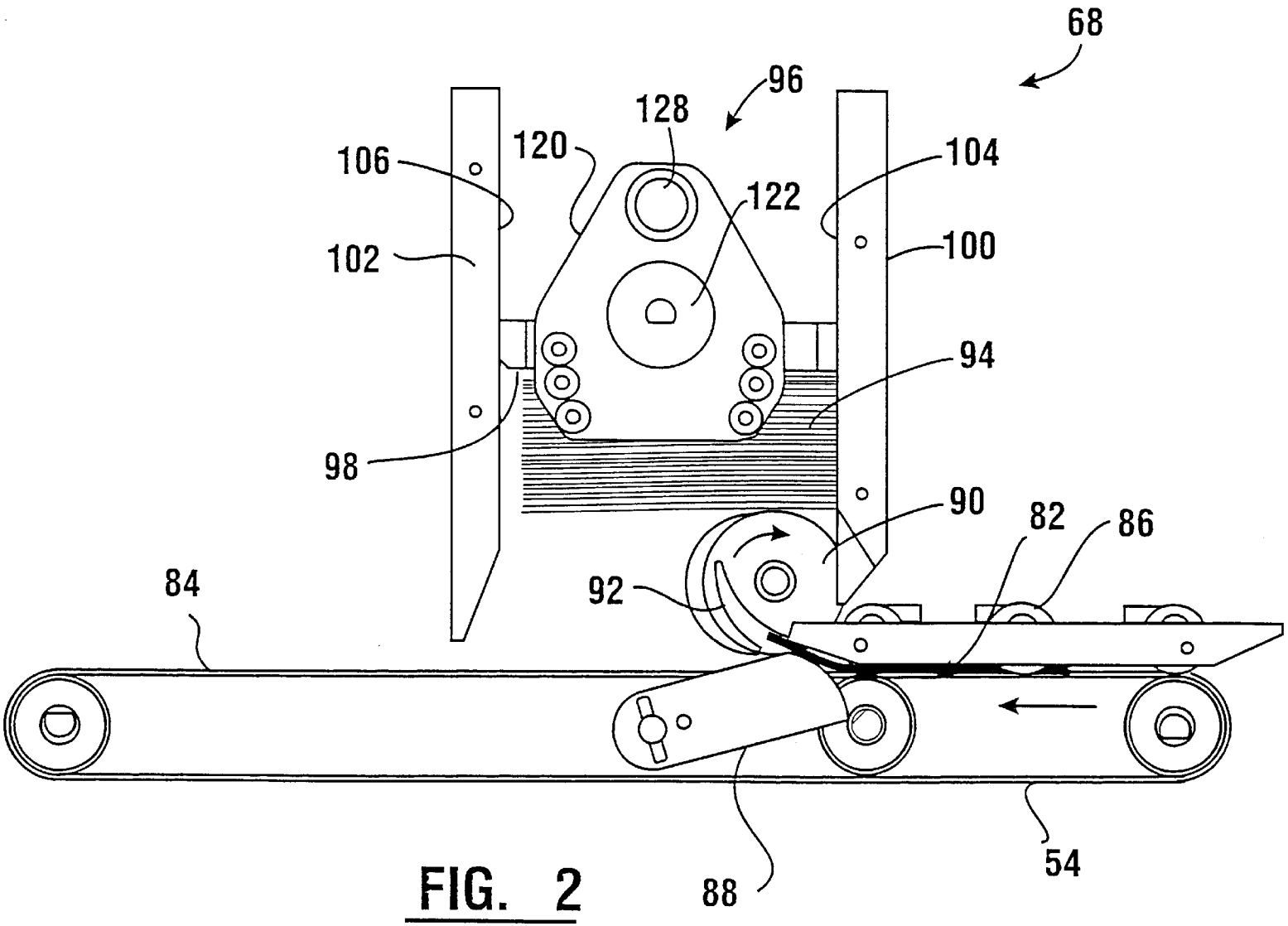
FIG. 2 is a side schematic view of a sheet stacking mechanism used in the automated banking machine shown in FIG. 1.

FIG. 2 shows sheet stacking mechanism 68 in a position for accepting a sheet indicated 82. The sheet is shown moving from right to left in FIG. 2. The sheet moves in connection with the sheet moving conveyor 54 between a belt flight 84 and idler rolls 86. A guide member 88 moves responsive to signals from the controller to a directing position shown in FIG. 2. In the directing position the guide member directs the leading edge of the sheet 82 to engage a flipper member 90. The flipper member is rotatably mounted in supporting connection with the frame of the machine and is selectively rotated by a drive or other suitable rotating mechanism which is operated under the control of the controller.

Flipper member 90 includes a peripherally extending slot 92. In an engaging rotational position of the flipper member shown in FIG. 2, the sheet is directed by the guide member 88 into the slot 92. A stack of sheets 94 is positioned in a sheet storage area between the flipper member 90 and a biasing mechanism generally indicated 96. The biasing mechanism 96 includes a stop member 98. The stop member 98 in this exemplary orientation is biased downward by a spring later shown in detail.

The stacking mechanism 68 further includes a first guide 100 and a second guide 102. The stop member 98 is movable in a generally vertical direction between the guides. The sheets in stack 94 are aligned in the stack with an edge of each sheet generally in abutting relation to a guide surface 104 of guide 100. The parallel guide surface 106 of guide 102 which bounds the storage area holding the stack is slightly disposed from the opposed edges of the sheets.

Figure 9:
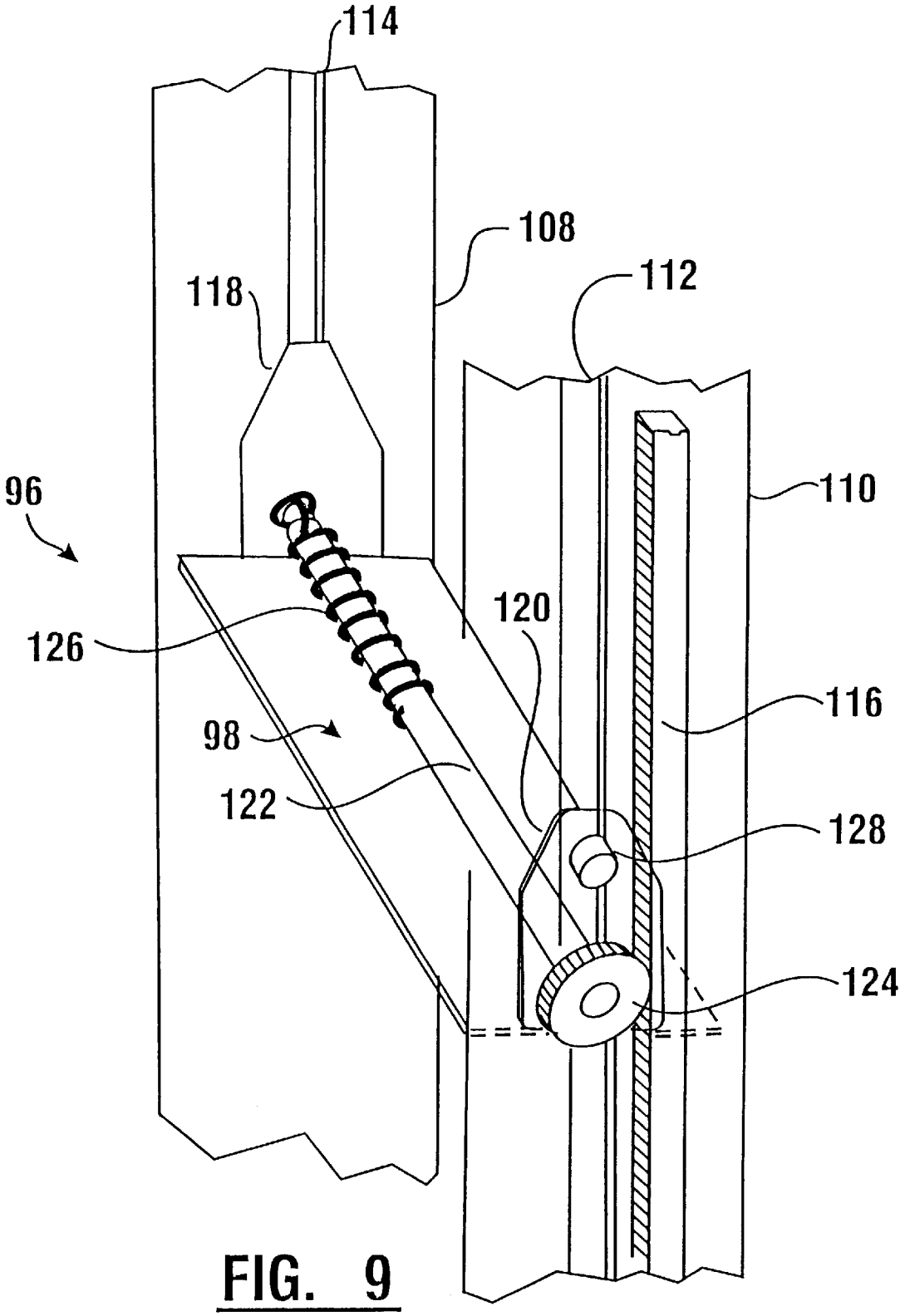
FIG. 9 is an isometric side view of a pressure plate mechanism.

The biasing mechanism 96 is shown in greater detail in FIG. 9. The stop member 98 extends between two walls 108, 110 which are disposed generally perpendicular to guides 100 and 102. Wall 110 includes an elongated opening 112 therethrough. Wall 108 includes a similar elongated opening 114. A gear rack member 116 is disposed adjacent to elongated opening 112 on the outside surface thereof. A similar gear rack member is disposed on the outside of elongated opening 114, although it is not shown.

Stop member 98 is attached to two journal portions 118 and 120. The shaft 122 is rotatably mounted and extends through the journal portions. Shaft 122 also extends outward through elongated openings 112 and 114. Gears 124 (only one of which is shown) are mounted at the outward ends of the shaft 122. Gears 124 are sized for engaging the adjacent gear rack members in meshing relation. The torsion spring 126 serves as a biasing member for biasing the stop member 98 toward the downward position. Torsion spring 126 is configured so that as the stop member is moved upward away from the flipper member 90, the rotational movement of the gears due to engagement with the gear rack members causes the torsion spring 126 to provide a downward reaction force.

Each of the journal portions 118 and 120 further include a guide projection 128, only one of which is shown. The guide projection extends outward into the adjacent elongated openings. The guide projections serve to maintain the journal portions in proper alignment and serve to facilitate movement of the stop member along the direction parallel to the guide surfaces bounding the sheet storage area. The configuration of the biasing mechanism 96 is well adapted for enabling movement of the stop member and the sheets in engagement therewith, while minimizing resistance and binding. Of course, it should be understood that this embodiment is exemplary and other embodiments may use other or additional mechanisms for holding or biasing a stack of sheets.

Figure 3:
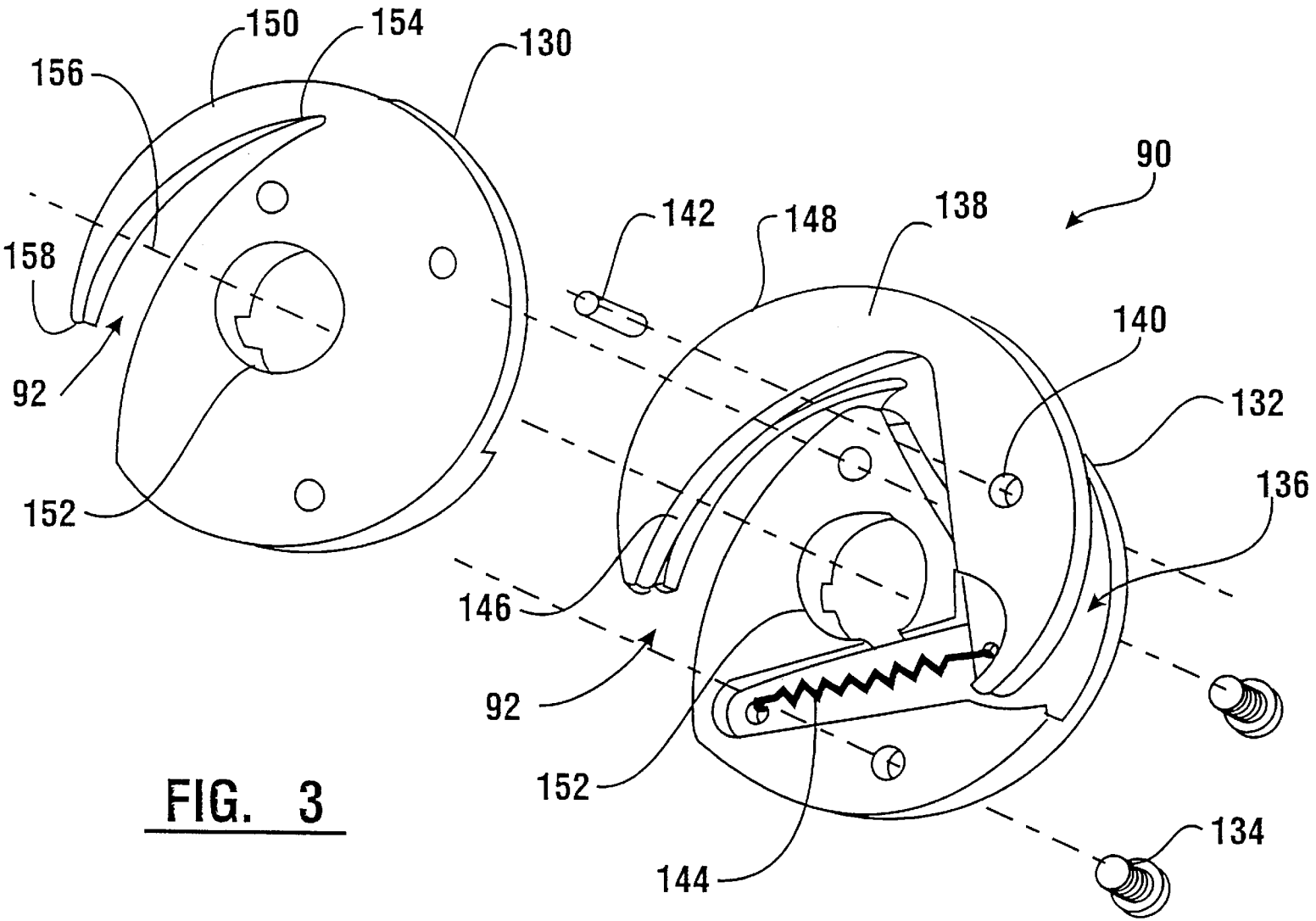
FIG. 3 is an isometric exploded view of a first form of a flipper member and a gripper member of a sheet stacking mechanism.

The operation of the stacking mechanism 68 is shown in greater detail with reference to FIGS. 3 through 7. FIG. 3 shows one embodiment of the flipper member 90 which is a rotatable member. The flipper member 90 includes a first flipper member half 130 and a second flipper member half 132 that is a mirror image of the first flipper member half. Each flipper member half includes a transverse portion of the peripherally extending slot 92. The flipper member halves are held together with fasteners 134 in the described embodiment. Of course in other embodiments other types of fastening and fabricating techniques may be used.

A radially extending recess 136 extends between the flipper member halves. A gripper member 138 is movably mounted in the recess 136. In the embodiment shown the gripper member 138 is rotationally movable relative to the flipper member about a pivot 140. Rotation about the pivot 140 is accomplished in the described embodiment through use of a pivot pin 142 which extends between the flipper member halves. It should be understood however that in other embodiments the gripper member or other movable member may be movable in other ways relative to the flipper member and may have other configurations. A spring 144 extends operatively between the flipper member and the gripper member and biases the gripper member to the position shown in FIG. 3. In this position the gripper member is biased towards a position in which an inner gripper surface 146 which serves as a gripper portion is disposed relative to slot 92 so that a sheet is enabled to move in the slot. An outer gripper activating surface 148 is biased to extend radially outward relative to the outer flipper surface 150 which overlies the slot.

As can be seen from FIG. 3, each of the flipper member halves include a central opening 152. The central opening 152 enables the flipper member to be mounted in relatively fixed relation on a shaft or similar member which may be used to rotate the flipper member in a manner later explained. Further in the exemplary embodiment of the flipper member shown, the slot 92 is configured to extend from an inward portion 154 of the slot 92. From the inward portion the slot extends as an arcuately outward extending spiral portion 156 until the slot meets the outer flipper surface adjacent a claw-like point 158.

Figure 4:
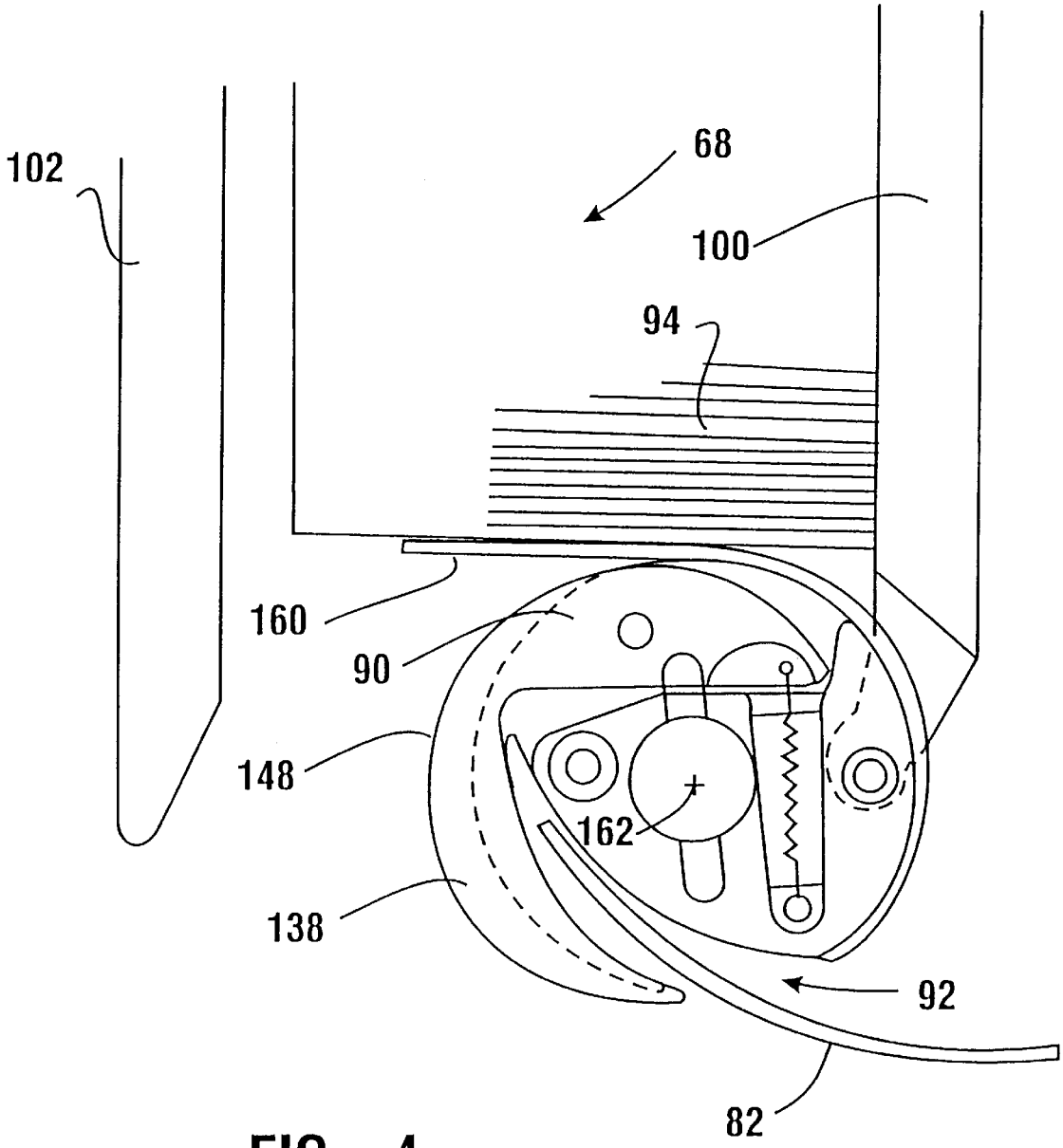
FIG. 4 is a schematic view of a sheet stacking mechanism in a first position.

The operation of the flipper member to move a sheet into the stack 94 in stacking mechanism 68 is shown in greater detail in FIGS. 4 through 7. In FIG. 4 the flipper member 90 is shown in an engaging position in which the slot 92 is rotated such that it can engage the sheet 82 while sheet 82 is moved as shown in FIG. 2 along a sheet path by a suitable drive or other sheet moving mechanism. When the guide member 88 is positioned as shown in FIG. 2 the sheet 82 moves into the slot 92 as shown in FIG. 4. Such movement is enabled because the gripper member 138 is biased to open the slot, and in the engaging rotational position of the flipper member the outer gripper activating surface 148 is disposed away from the sheets in the stack 94. In the embodiment of the flipper member 90 shown, a flexible flap 160 is operatively connected to the flipper member adjacent the opening to slot 92. As later explained in detail the purpose of the flexible flap is to urge sheets which are moved by the flipper member into the stack.

As the sheet 82 moves to enter the slot 92 the sheet is sensed by a sensor operatively connected to the controller. The flipper member 90 begins to rotate about an axis 162 in the clockwise direction as shown. The flipper member is rotated about the axis by a motor or other suitable drive device or moving mechanism which is operated responsive to signals from the controller. The flipper mechanism 90 rotates to the position shown in FIG. 5. In this position, which is generally at about the engaging position, the gripper member 138 rotates about the pivot 140 so that the sheet 82 is held generally in fixed engagement with the flipper member in the slot. The gripper member 138 is moved to a position holding the sheet in the slot by the moving mechanism which rotates the flipper member. Specifically in the embodiment shown the outer gripper actuating surface 148 engages a cam moving surface, which in the condition shown is an outer surface of the lowest sheet in stack 94. As the flipper member rotates such engagement overcomes the force of spring 144 and causes the sheet 82 to be held in fixed engagement in the slot 92. It should be understood that in conditions where a stack of sheets is present, a portion of the adjacent surface of the outermost sheet serves as the cam moving surface upon each rotation of the flipper member. When no sheets are present, the lower surface of the stack member 98 includes the cam moving surface which operatively engages the gripper member and enables movement of the first sheet into the stack.

Figure 5:
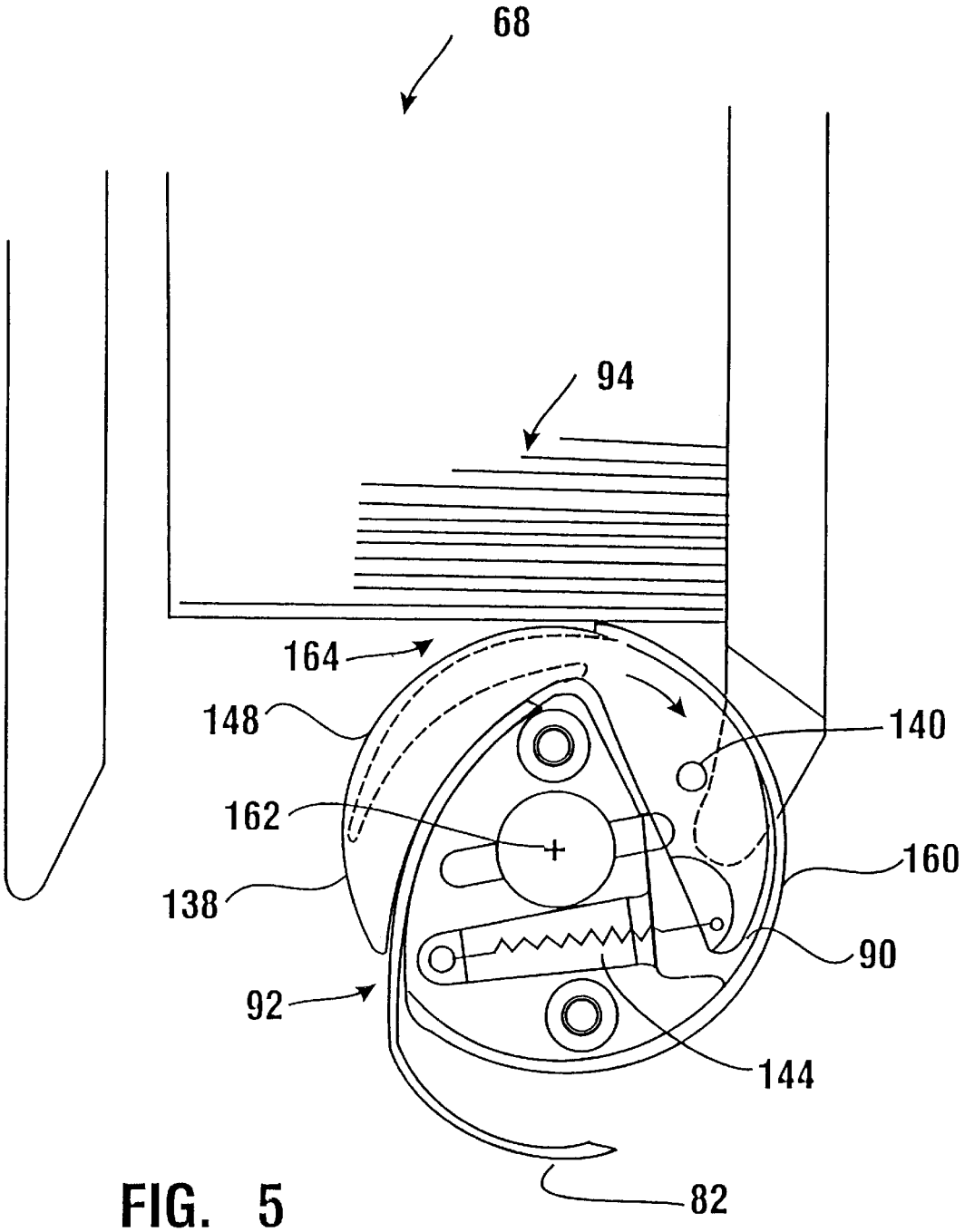
FIG. 5 is a schematic view of a sheet stacking mechanism in a second position.
Figure 6:
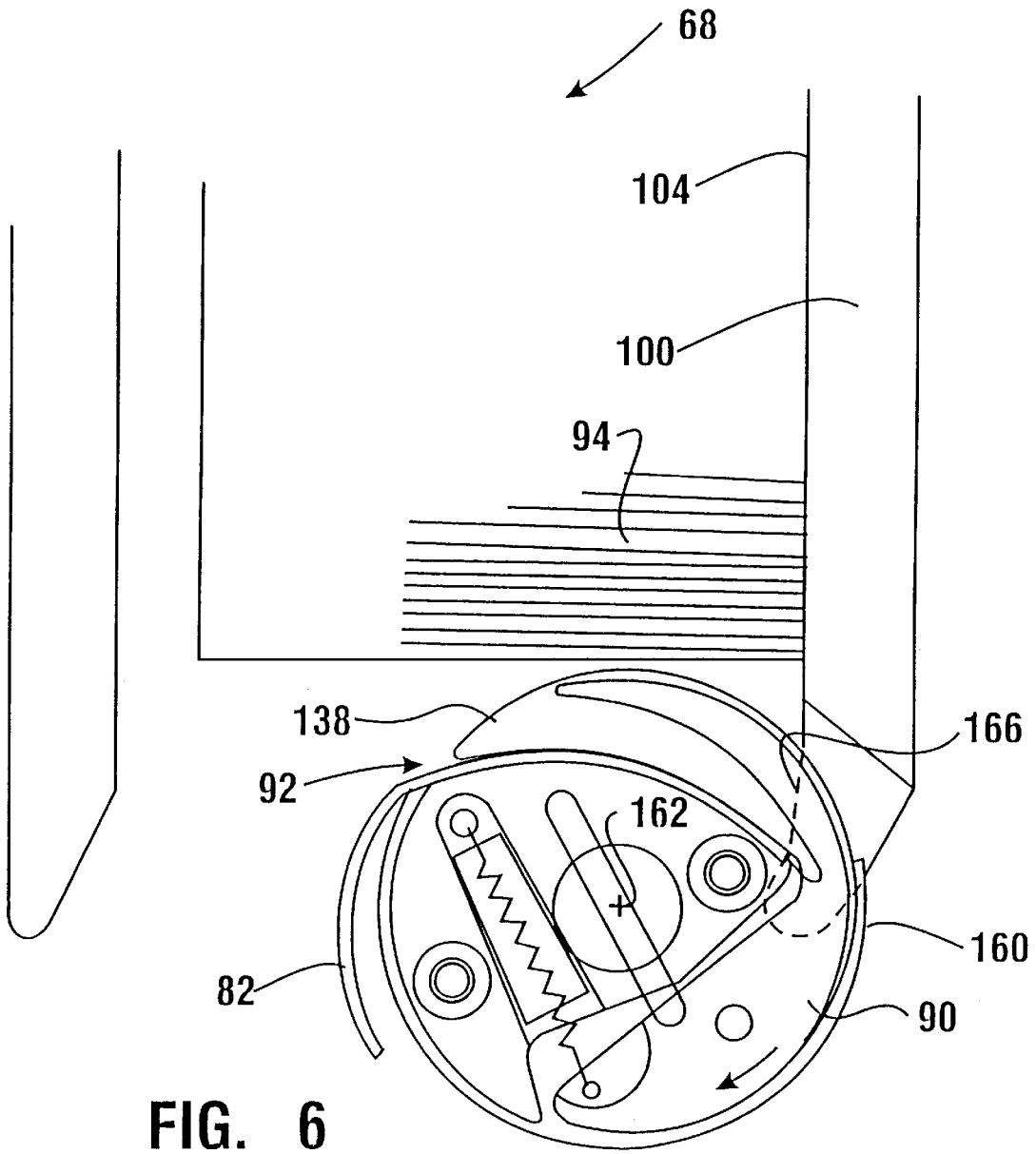
FIG. 6 is a schematic view of a sheet stacking mechanism in a third position.
Figure 7:
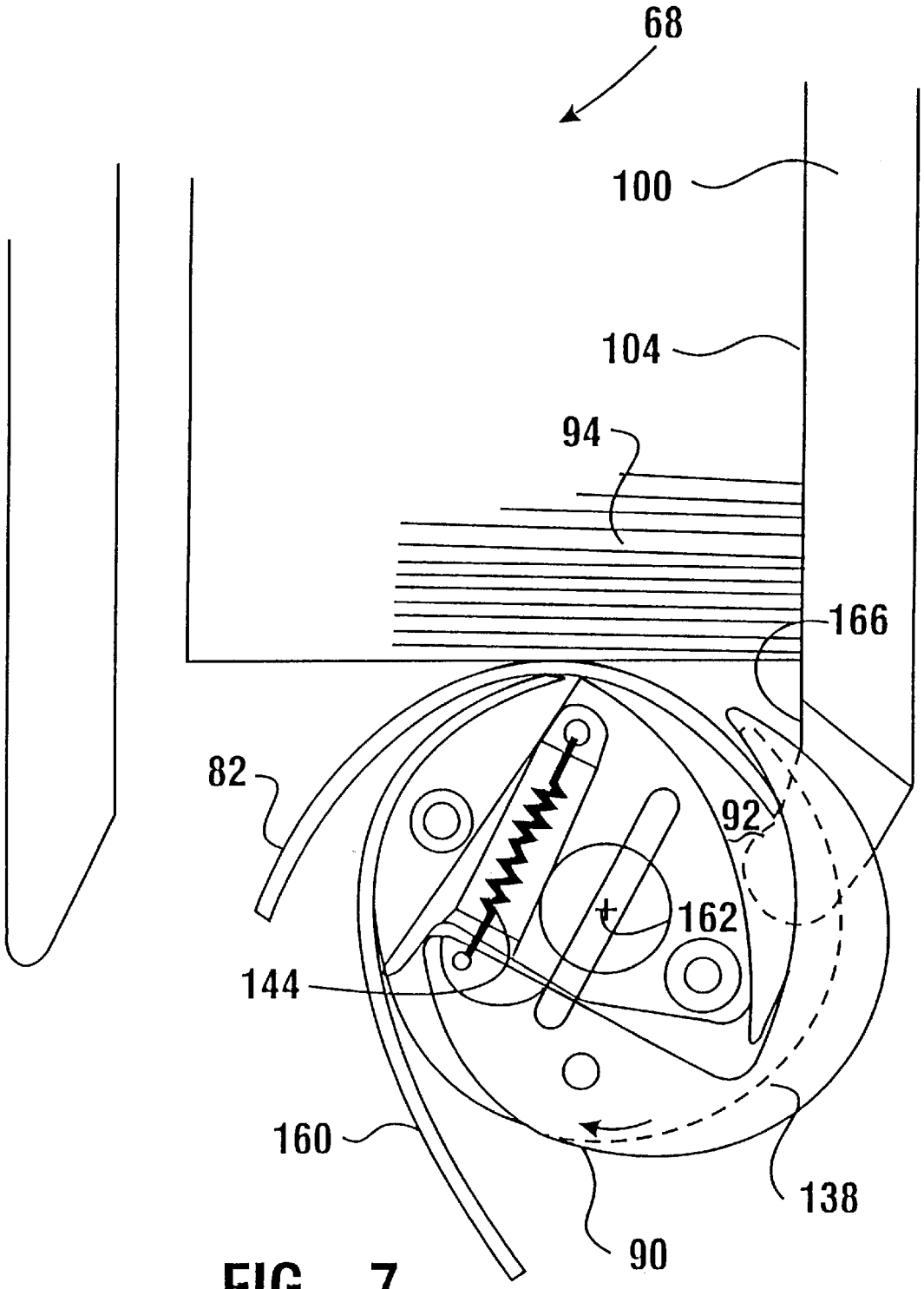
FIG. 7 is a schematic view of a sheet stacking mechanism in a fourth position.

From the position shown in FIG. 5 the flipper member 90 continues rotating about axis 162. The inward edge of the sheet engages a stop surface 166. The stop surface 166 extends adjacent to and intersects a projection of the slot 92 in the transverse direction when the flipper member 90 is in the releasing position shown in FIG. 6. The stop surface 66 in the embodiment shown extends generally transversely and parallel to the axis 162 about which the flipper member 90 rotates. As shown in the Figure the stop surface also extends generally perpendicular to the leading edge portion of the sheet at the point of engagement.

The engagement of the leading edge portion of the sheet 82 at the stop surface 166 urges the sheet 82 out of the slot 92. Further, rotation of the flipper member 90 in the clockwise direction generally to the releasing position causes the gripper member 138 to generally operatively disengage from the cam moving surface on the outermost sheet in the stack. The gripper member is biased outward by the spring 144. As a result the sheet 82 is enabled to move relative to the slot 92 so that the sheet is aligned and integrated into the stack 94. The rotation of the flipper member 90 clockwise beyond the position shown in FIG. 7 further serves to bring the flexible flap 160 to engage the outer face of the sheet 82 so as to urge the sheet into engagement with the other sheets in the stack. Further, the rotation of the flipper member such that the sheet passes out of the slot 92 brings the leading edge portion of the sheet into registration against the guide surface 104 of guide 100. As a result the sheet 82 is properly positioned as the end sheet bounding the bottom of the stack.

The flipper member 90 continues to be moved by the moving mechanism in the clockwise direction until the flipper member returns to the engaging position shown in FIG. 4. In this position the flipper member is ready to receive another sheet from the sheet path.

Figure 8:
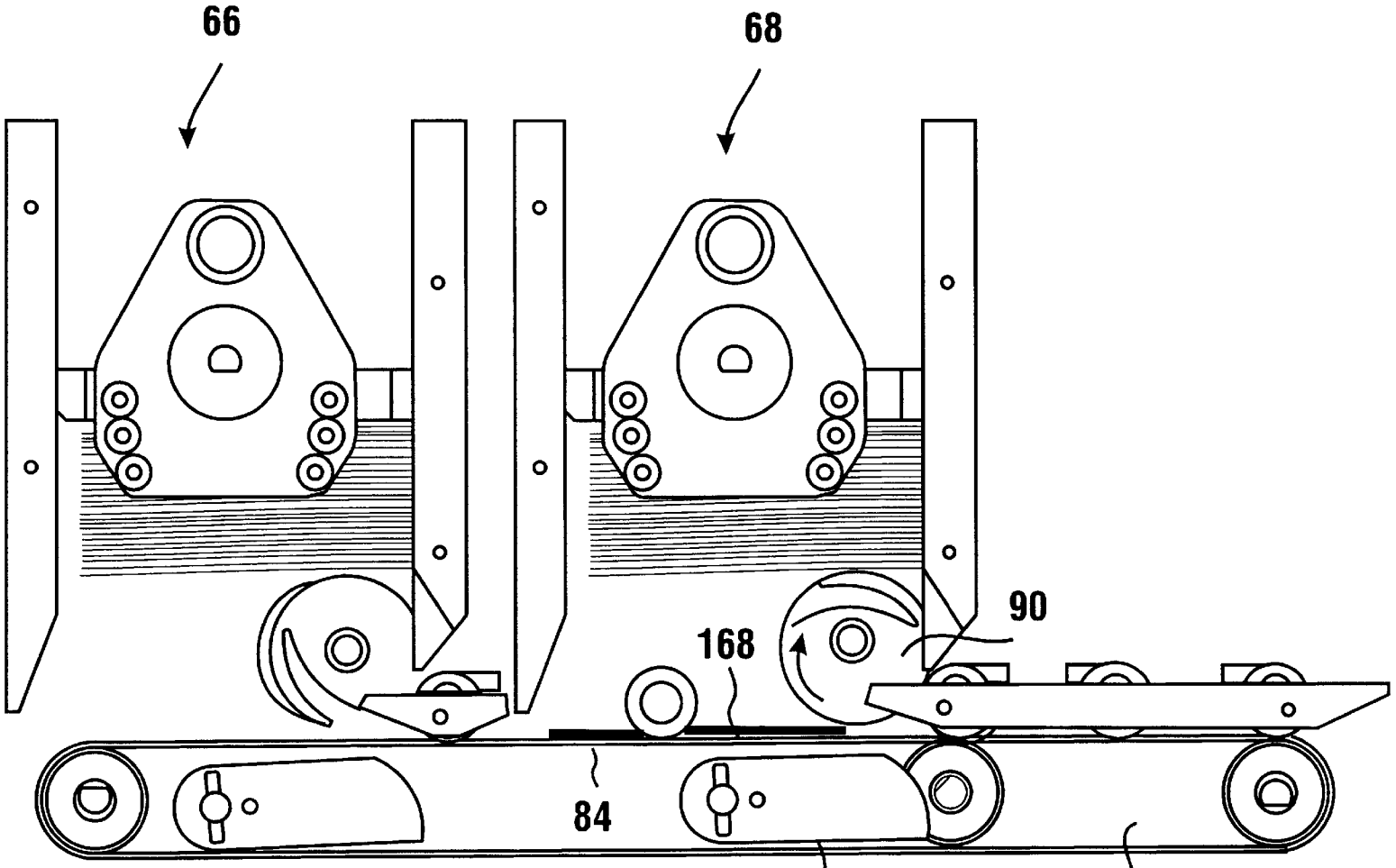
FIG. 8 is a side schematic view of a plurality of sheet stacking mechanisms arranged in adjacent relation.

It should be understood that each of the stacking mechanisms 60, 62, 64, 66 and 68 are each capable of receiving sheets from the sheet path which extends along the sheet moving conveyor 54. As represented in FIG. 8 when it is desired to move a sheet such as a sheet 168 past stacking mechanism 66 to another stacking mechanism, guide member 88 may be positioned to enable the sheet to pass along the sheet path. The flipper member 90 may be rotated to facilitate passage of the sheet past the stacking mechanism. Additional idler rolls are also preferably provided to facilitate movement of the sheets along the length of the sheet moving conveyor 54. The associated guide members and flipper members of the other stacking mechanisms are selectively operated responsive to the controller to stack sheets therein.

It should be understood that while one flipper member has been described in connection with moving sheets into a stacking mechanism, embodiments of the invention will generally use a plurality of transversely disposed flipper members so that the sheet may be held at a number of transverse locations while moving the sheet into the stack. While the moving mechanism rotating the flipper member is also operative in the described embodiment to move the gripper mechanism between the first position in which the note is held in the slot and the second position in which the note is movable therein, other embodiments of the invention may use other types of moving mechanisms for moving the gripper member or other gripper portion which operates to engage a sheet. In addition while cam action is used in the described embodiment, other types of configurations for the gripper mechanism may be used including those later described in detail herein.

The stacking mechanisms of the exemplary automated banking machine 10 are preferably used for holding sheets which are not to be dispensed again by the machine to users. These may be sheets such as checks or vouchers which are to be voided once presented by the user. Alternatively the sheets stored in the stacking mechanisms may be denominations of bills which the controller determines are not needed for recycling. These may include for example one dollar and five dollar bills which when received by the machine from a user are stored for later removal rather than being recycled. It should be understood that embodiments of the invention may include a greater number or lesser number of stacking mechanisms than is shown in this exemplary embodiment.

It will further be appreciated that each of the stacking mechanisms is operated as a module such that each may operate independently. This enables machines of various embodiments to include different numbers and configurations of stacking mechanisms. This modular construction facilitates the construction of machines in which documents may be moved past one module to a next module for purposes of stacking therein. The recycling mechanisms 56 and 58 are also modular and facilitate reconfiguring machines to include different configurations of storing mechanisms and recycling mechanisms. Numerous configurations of automated banking machines employing the principles of the present invention may be achieved due to the use of the modular construction described herein.

Figure 10:
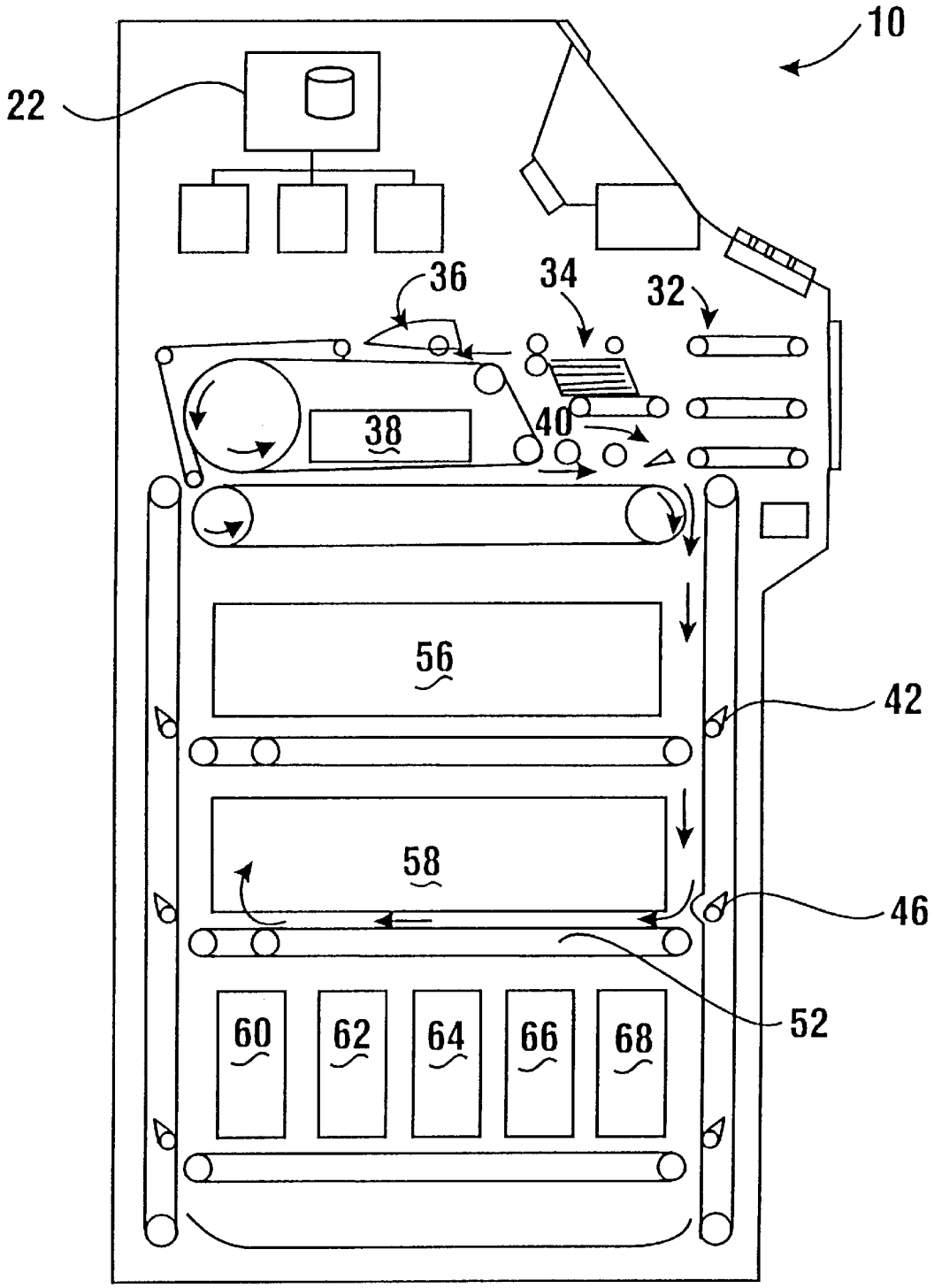
FIG. 10 is a schematic view of the automated banking machine shown in FIG. 1 shown in the position accepting sheets into a recycling mechanism.

FIG. 10 schematically represents an alternative operation of the exemplary automated banking machine 10 in which sheets are stored for later recovery in the recycling mechanism 58. In this embodiment a sheet is moved as in the previous embodiment to the input sheet conveyor 42. The controller 22 operates the divert gate 46 which serves as a diverter to direct the sheet onto a sheet path along the sheet moving conveyor 52.

Figure 11:
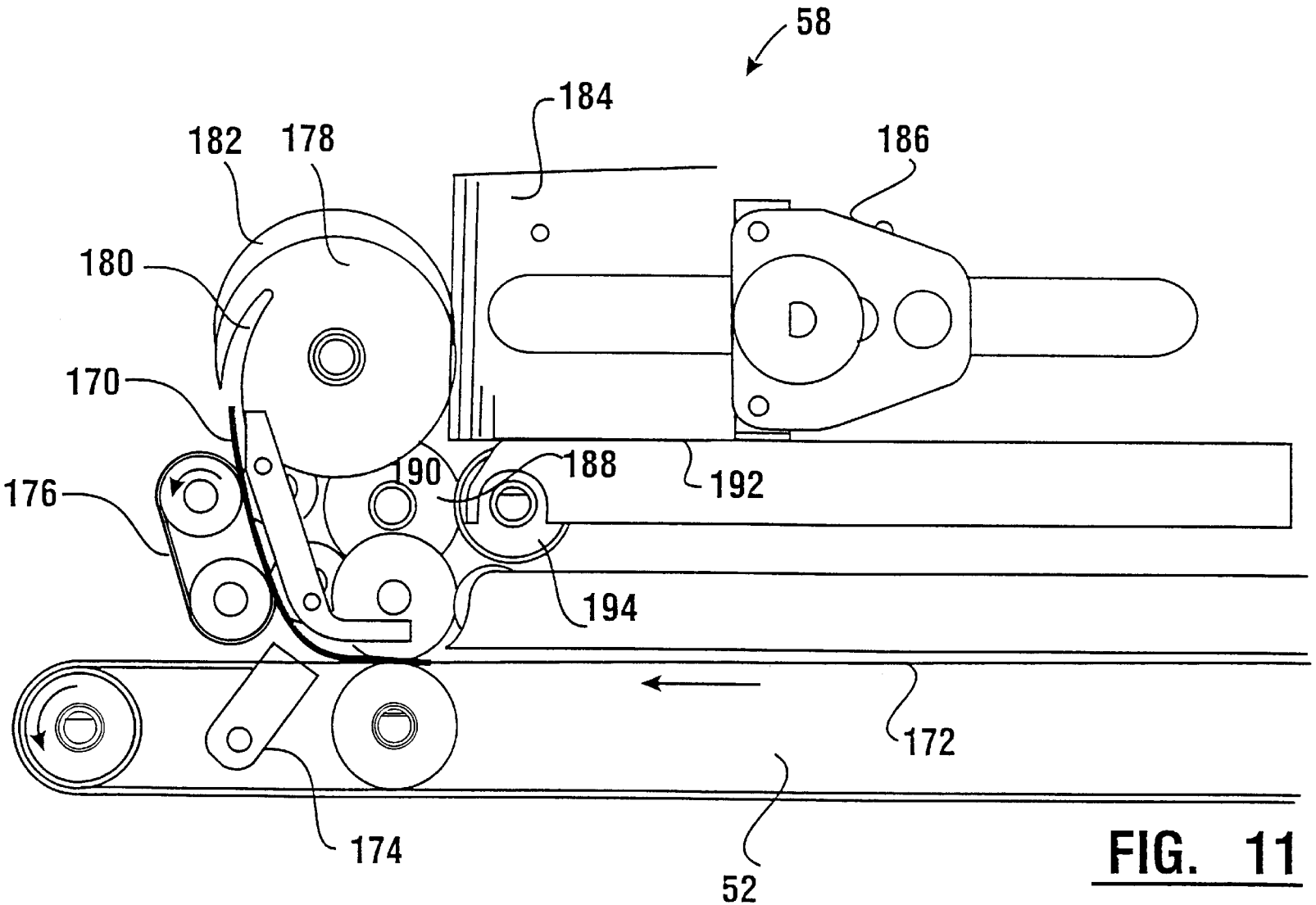
FIG. 11 is a schematic side view showing the recycling mechanism accepting a sheet.

As shown in FIG. 11 in this exemplary embodiment a sheet 170 is moved from right to left in connection with a belt flight 172 of sheet moving conveyor 52. The sheet is directed by movement of a guide member 174 which serves as a diverter to engage in-feed rolls 176. The incoming sheet is guided along an incoming sheet path by the in-feed rolls to a rotatable flipper member 178. The flipper member 178 includes a slot 180 extending thereon. The flipper member 178 further has a movably mounted gripper member 182 movably mounted thereon.

The flipper member 178 and its associated gripper member 182 operate when receiving a sheet, in a manner generally similar to the previously described flipper member 90. The flipper member 178 rotates in response to a moving mechanism to move the incoming sheet 170 into a stack 184. The stack is held in sandwiched relation by a biasing mechanism 186 which is similar to biasing mechanism 96 except that it is configured to hold and bias the stack horizontally in this exemplary embodiment.

In this alternative form of the invention sheets are released from the flipper member 178 by engaging a stop surface 188 which includes an outer surface of a picking feed roll 190. When the stack is receiving a sheet as shown in FIG. 11 the feed roll 190 is preferably stationary. Sheets stopped against stop surface 188 of feed roll 90 are eventually biased by the addition of new sheets to the stack 184, against a guide surface 192. The sheets are guided to engage the guide surface 192 by a surface of stripper rolls 194. As later discussed, the stripper rolls are in connection with a clutch mechanism that enables rotation thereof freely in a clockwise direction as shown, but prevents rotation thereof in a counterclockwise direction. As a result stripper rolls 194 are enabled to rotate in a manner which facilitates the engagement of the sheets with the guide surface.

Figure 12:
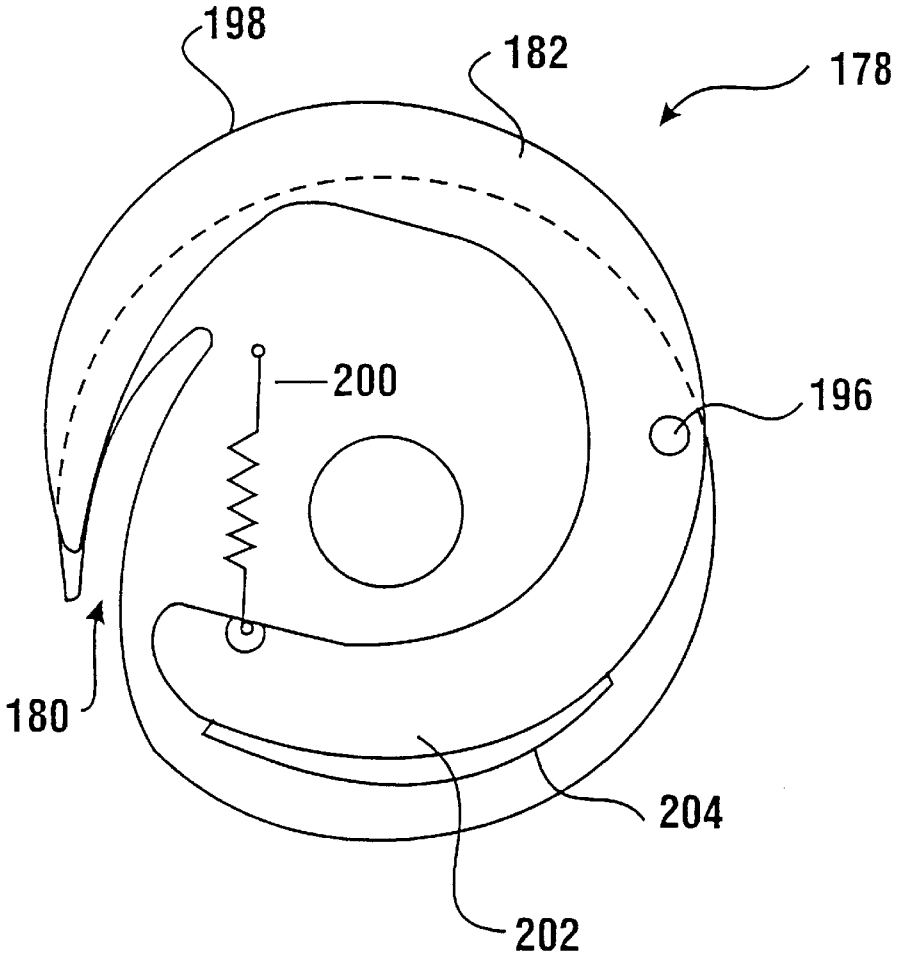
FIG. 12 is a side view of an alternative form of a flipper member and a gripper member used in a sheet recycling mechanism.

The flipper member 178 of this alternative embodiment is shown in greater detail in FIG. 12. It is generally similar to flipper member 90 except as described. In this embodiment the gripper member 182 is rotationally movable relative to the flipper member about pivot 196. An outer gripper actuating surface 198 extends on the gripper member adjacent to the slot 180 and functions in a manner similar to the outer gripper actuating surface 148 of the previously described embodiment. A spring 200 serves as a biasing member to bias the outer gripper surface in the manner shown.

Gripper member 182 further includes a high friction picker portion 202 which extends on the movable member on the opposite side of pivot 196 from outer gripper surface 198. Picker portion 202 includes a high friction resilient segment 204 which is comprised of a material suitable for engaging and pulling sheets from the stack 184. As can be appreciated, the angular configuration of the picker portion 202 is such that when the outer gripper surface 198 is acted upon by the cam moving surface on the outermost sheet of the stack (or the stack member if no sheets are present) during a sheet accepting operation, the picking segment projects from the flipper member in an area where its presence does not generally affect the sheet accepting and stacking operation. In a sheet accepting operation the operation of flipper member 178 operates in a manner comparable to flipper member 90.

Figure 13:
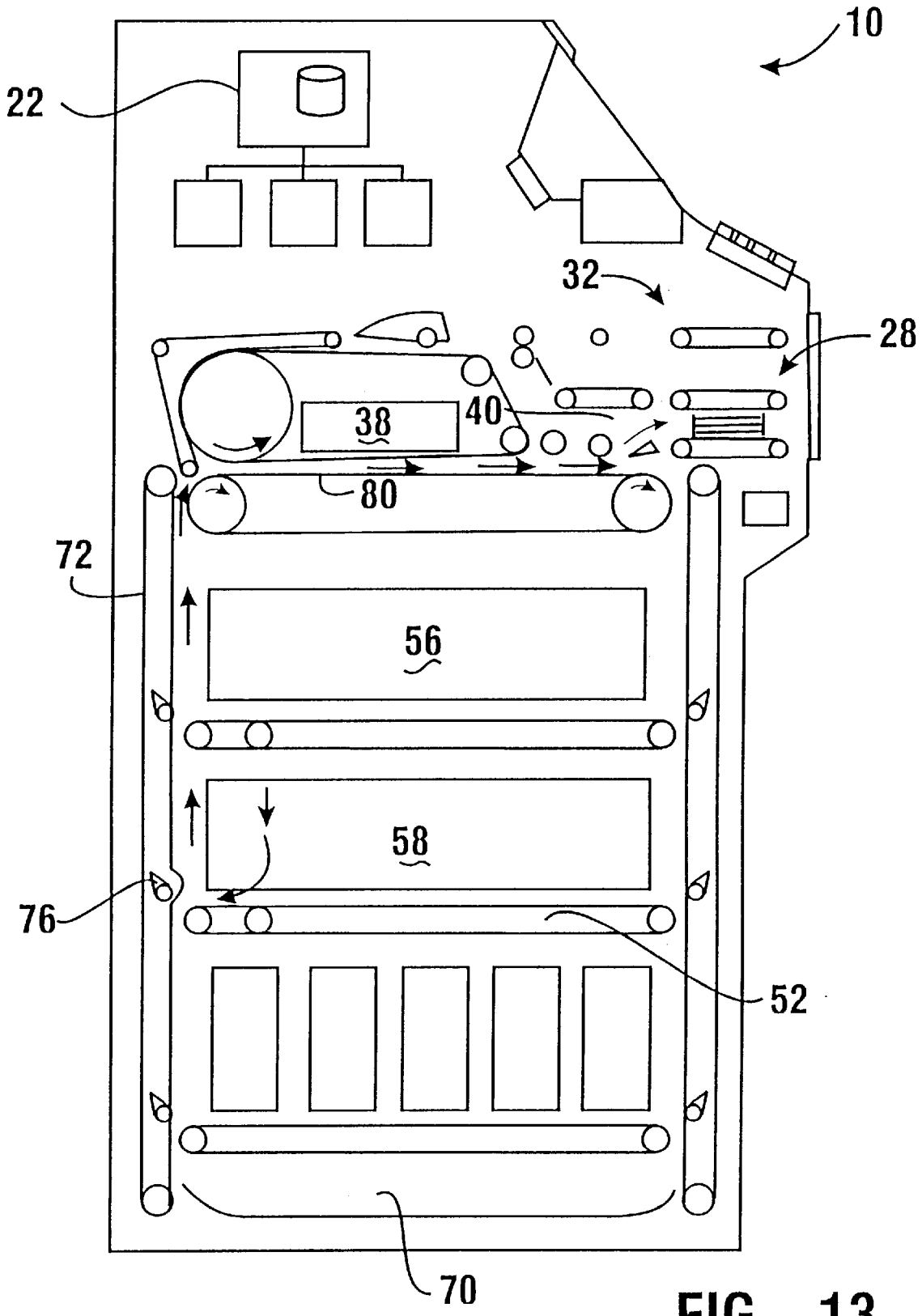
FIG. 13 is a schematic view of the automated banking machine shown in FIG. 1 shown dispensing a sheet from a recycling mechanism.

Referring now to FIG. 13, an operation in which the automated banking machine 10 operates to retrieve the sheet from storage in the recycling mechanism 58 is represented. In this circumstance a sheet is removed from the stack 184 in the recycling mechanism 58 in a manner later described in detail. The sheet moving conveyor 52 moves the delivered sheet along the sheet path until the sheet engages the output sheet conveyor 72. The divert gate 76 is operated to cause the sheet to engage the output conveyor. The sheet is then conveyed upward as shown in FIG. 13 to the central conveyor 80 which moves the sheet past the sheet identification mechanism 38. The sheet identification mechanism verifies the identity of or type sheet. If the sheet is an appropriate sheet the controller 22 operates the divert mechanism 40 to direct the sheet into the appropriate location in the escrow and delivery mechanism 32. From the escrow and delivery mechanism the sheet may be delivered to a customer either individually or as part of a stack through the opening 28 in the frame of the machine.

The operation of the recycling mechanism 58 to dispense a sheet is now further described with reference to FIGS. 14 and 15. The flipper member 178 may be operated to urge a sheet to move from the stack by extending the picker portion 202 therefrom. This is achieved by engagement of an actuating member 206 with an appropriate portion of the outer surface of the flipper member. Actuating member 206 is operated by a device or moving mechanism such as a motor or other actuator operated under the control of controller 22.

Figure 14:
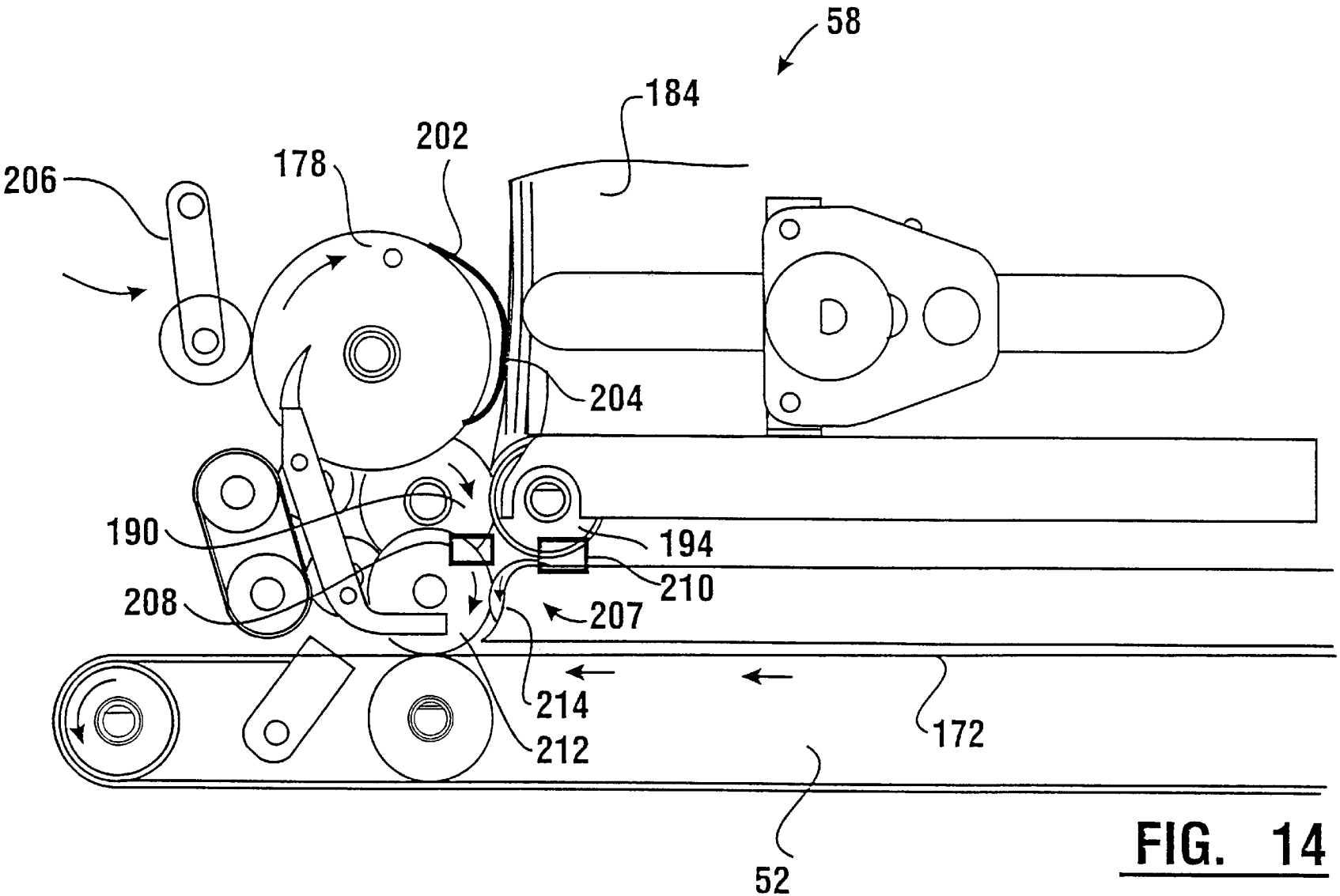
FIG. 14 is a side schematic view of the recycling mechanism dispensing a sheet.

As shown in FIG. 14 engagement of the actuating member 206 with the flipper member 78 causes the picker portion 202 on the gripper member to extend outward relative to the outer flipper surface. In the extended position of the picker portion the high friction segment 204 engages the outermost sheet in the stack 184. The rotation of the flipper member in the clockwise direction by a moving mechanism causes the outermost sheet to be urged downward as shown into an outgoing sheet path which extends between the picking feed rolls 190 and the stripper rolls 194. The picking feed rolls 190 are rotated in the clockwise direction as shown in FIG. 14 by a device such as a drive or other mechanism. The picking feed rolls are configured to apply a greater force to the adjacent surface of the first sheet than the force applied by stripper rolls which tends to hold the sheet in the stack. As previously discussed, the stripper rolls are prevented from moving in a counterclockwise direction. As a result all but the outermost sheet of the stack is generally prevented from being moved by the picking feed rolls 190 from the stack.

Figure 15:
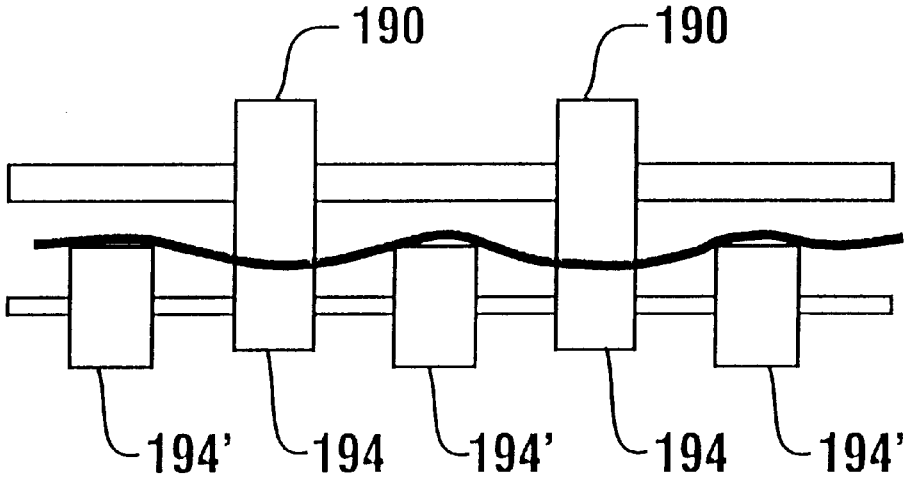
FIG. 15 is a front plan view of a picker/stripper mechanism used for picking and separating sheets in the recycling mechanism.

As shown in FIG. 15 the stripper rolls in this exemplary embodiment include contact stripper rolls which are in opposed and abutting relation with the feed rolls, as well as non-contact stripper rolls 194' which are transversely disposed and not in opposed relation with a feed roll. This configuration imparts a cross sectional wavelike or waffle configuration to the outermost sheet which facilitates separating the outermost sheet from the other sheets in the stack. Other embodiments may include other or additional moving or stationary surfaces for purposes of imparting the wavelike or waffle configuration to the sheet. It should be understood that while surfaces of rolls are used for picking and stripping in the described embodiment, in other embodiments other types of moving or stationary members may be used.

As shown in FIG. 14 a doubles detector schematically indicated 207 is positioned adjacent to and downstream of the feed roll 190 and stripper rolls 194 in the outgoing sheet path. The exemplary doubles detector 207 includes an emitter 208 and a receiver 210. The emitter and receiver in the embodiment shown transmit radiation through and/or sense radiation reflected from a picked sheet to determine if the sheet that has been moved from the stack is a proper single sheet or if it is a double or other multiple sheet. It should be understood that while in this embodiment a radiation type doubles detector is used, in other embodiments other types of doubles detectors such as contact type detectors may be used.

The signals from the doubles detector 207 are transmitted to the controller 22. If the signals correspond to a single sheet, a takeaway member or device in the outgoing sheet path such as takeaway rolls 212 and 214, is operated by a drive or other moving mechanism. The takeaway rolls operate to pull the sheet further downward so as to disengage the stack. The takeaway rolls further operate to engage the sheet with flight 172 of sheet moving conveyor 52 so as to place the outgoing sheet into the main sheet path. As a result the outgoing sheet is removed from the stack and directed through the machine as previously described for delivery to a user.

In the event the doubles detector 207 provides signals which suggest that more than one sheet is being pulled downward from the stack, the controller 22 in an exemplary embodiment operates to reverse the direction of the picking feed rolls 190. Because the stripper rolls 194 are free wheeling in the clockwise direction as shown in FIG. 14, rotation of the feed rolls in the counterclockwise direction readily pulls the sheets back into the stack. The flipper member is generally positioned with the high friction segment away from the stack. In some embodiments the flipper member 178 may remain stationery as the sheet is returned to the stack by the feed rolls and in others the flipper member may be rotated in an opposed direction from the direction the flipper member rotates during picking. The flipper member 178 may then be operated to perform an additional rotation in the picking direction as the feed rolls and stripper rolls again attempt to pull a single sheet from the stack. This process may be repeated in response to signals from the controller until a single sheet is separated from the stack.

In the event that repeated attempts to strip a single sheet are unsuccessful, double sheets which cannot be separated may be transported in the machine responsive the controller 22 operating the divert gates and the input sheet conveyor 42 and/or output sheet conveyor 72 to move the unacceptable sheets downward into the dump storage area 70. The controller may then operate the moving mechanisms in an attempt to pick another sheet. Of course alternative embodiments may sense for double sheets in other ways or at other locations. Some embodiments may operate to deliver double sheets if such sheets are accurately identified and multiple sheets are required. Alternatively embodiments may operate to divert multiple sheets to storage locations or route them for separation through an unstack operation.

FIGS. 16 through 29 show an alternative embodiment of a recycling mechanism generally indicated 216. Recycling mechanism 216 is generally similar to recycling mechanism 58 previously described except as specifically discussed. Recycling mechanism 216 may be used within an automated banking machine for purposes of receiving and storing bank notes or other sheets and then later selectively dispensing the stored sheets from storage.

Figure 16:
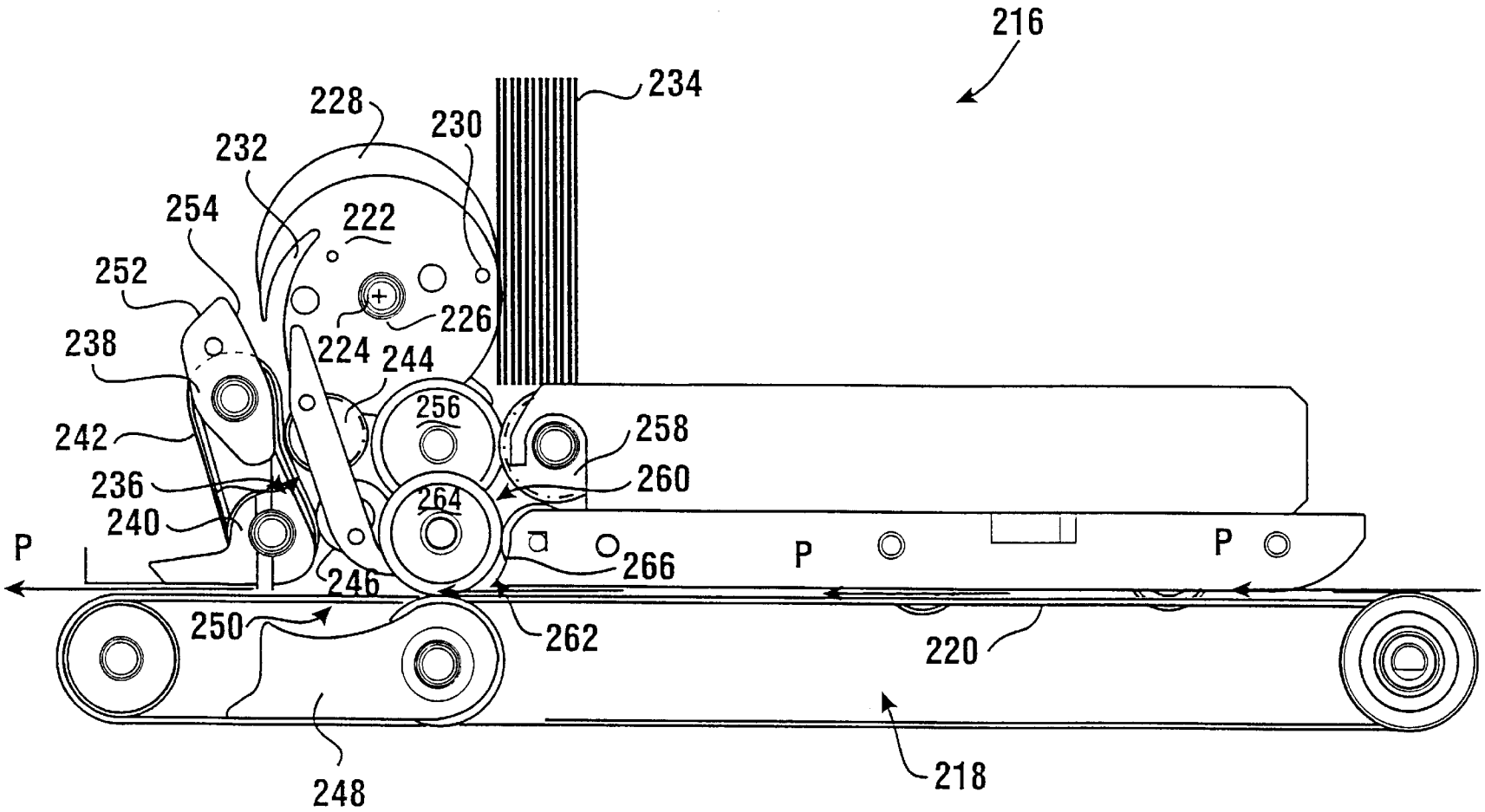
FIG. 16 is a side view of an alternative form of a recycling mechanism in a condition where sheets pass by the mechanism in a main sheet path.

Recycling mechanism 216 is positioned adjacent to a sheet moving conveyor 218. Conveyor 218 includes a belt flight 220 which defines a main sheet path. Sheets move in the main sheet path from right to left as shown in FIG. 16.

It should be understood however that in other embodiments of the invention sheets may move in more than one direction in the main sheet path.

Recycling mechanism 216 includes a rotating member 222. Rotating member 222 is similar to flipper 178 and is selectively rotatable about an axis 224 of a shaft member 226 which supports the rotating member. As discussed in the previous embodiment, the rotating member 222 is selectively rotated by rotation of the shaft responsive to signals from the controller.

Rotating member 222 similar to the flipper member previously described, includes a moveable member 228 moveably mounted in connection therewith. The moveable member 228 is connected to member 222 through a pivot 230. The rotating member 222 further includes a peripherally extending slot 232. Sheets are enabled to be engaged with a gripper portion of the moveable member when positioned in slot 232 such that an engaged sheet may be moved and deposited into a stack 234. As in the previously described embodiment, the stack 234 is supported and biased to engage the rotating member by a suitable mechanism.

An incoming sheet path generally indicated 236 is operative to direct sheets from the main sheet path to the rotating member 222. The incoming sheet path 236 is bounded by rolls 238, 240 which support a sheet engaging belt 242 thereon. The incoming sheet path 236 is also bounded by rolls 244 and 246. In the exemplary embodiment of recycling mechanism 216, belt 242 is driven responsive to the controller by a motor or other suitable driving means. The configuration of belt 242 and rolls 238, 240, 244 and 246 is such that sheets directed into the incoming sheet path move in engagement with the moving flight of belt 242 adjacent to rollers 244 and 246 such that the sheet moves adjacent to the rotating member 222.

The incoming sheet path intersects the main sheet path at a connection area generally indicated 250. A moveable diverter 248 is mounted adjacent to connection area 250. Diverter 248 is selectively moveable responsive to operation of the controller in a manner later discussed to enable passing sheets to be directed into the incoming sheet path or to pass through the connection area 250 without entering the incoming sheet path.

In the exemplary embodiment of recycling mechanism 216, an actuator 252 is positioned adjacent to rolls 238 and 244 in the incoming sheet path. Actuator 252 in the exemplary embodiment is rotatable and coaxially mounted with roll 238. Actuator 252 is selectively positionable responsive to the controller. Actuator 252 also includes a guide surface 254. Guide surface 254 is positionable in a manner later explained to direct sheets in the incoming sheet path to engage the rotating member 222.

It should be understood that while only one rotating member and set of rolls bounding the sheet path are shown, embodiments of the invention may include multiple transversely spaced rotating members, belts and rolls to move sheets therein. In addition, in embodiments of the invention several diverter members 248 and actuators 252 may work in cooperating relation to move sheets as later described herein.

Recycling mechanism 216 further includes a feed roll 256 and a stripper roll 258. In this exemplary embodiment feed roll 256 is similar to feed roll 190 of the previously described embodiment. Stripper roll 258 in the exemplary embodiment includes both contact and non-contact stripper rolls similar to stripper rolls 194 and 194' as previously discussed. It should be understood that while only one feed roll and one stripper roll are shown, embodiments of the invention may include a plurality of each of such rolls which are transversely disposed, similar to the previously described embodiment. In addition while a roll has been used for each of the feed and stripper members in this exemplary embodiment, in other embodiments other sheet engaging devices such as belts, cams, suction cups or other moveable members may also be used as a feed member. Other types of stripper members, other than rolls, such as pads, fingers, brushes, flaps or other devices may be used to perform the stripping function in other embodiments.

In this exemplary embodiment the feed roll 256 and stripper roll 258 bound and define an outgoing sheet path generally indicated 260. The outgoing sheet path 260 extends generally downward in the orientation of the mechanism shown in FIG. 16, from the stack 234 to a connection area 262 at which the outgoing sheet path connects to the main sheet path along belt plate 220.

Disposed between the feed and stripper rolls and the connection area 262 in the outgoing sheet path are take away rolls 264 and 266. Take away rolls 264 and 266 operate to engage a sheet which is moved beyond the feed and stripper rolls. A sheet that has moved beyond the feed and stripper rolls is moved in engaged relation with the take away rolls into the main sheet path. It should be understood that while rolls are used as the take away members in the exemplary embodiment of recycling mechanism 216, in other embodiments other types of take away members which are operative to engage the sheet and move it in the outgoing sheet path may be used.

Although not shown, it should also be understood that the outgoing sheet path may include a sensor for sensing that double sheets have passed the feed and stripper members which operate in a manner similar to the sensors in doubles detector 207 previously described. In recycling mechanism 216 the feed rolls 264, stripper rolls 268 and take away rolls 264 and 266 are driven by a drive or similar device responsive to operation of the controller. These members are operated in a manner later described in detail to selectively dispense sheets generally one at a time from the stack 234 and to deliver them into the main sheet path.

In operation of a machine that includes the recycling mechanism 216, it may be desirable in some circumstances for notes or other sheets to pass the recycling mechanism without being stored therein. To achieve this the controller operates to cause the diverter member 248 to move to the position shown in FIG. 16. In this way one or more sheets which are indicated by arrows P are enabled to move past the recycling mechanism 216 in the main sheet path along the belt plate 220. It should be understood that the recycling mechanism 216 may be positioned along a sheet path in an automated banking machine along with other similar recycling mechanisms or other devices. As a result sheets which move past recycling mechanism 216 may be routed to such devices along the sheet path or in other connected sheet paths. Alternatively, embodiments of the invention may move sheets along the sheet path within the machine for purposes of reorienting the sheet such that sheets stored therein may be stored in a particular orientation in a storage or recycling mechanism after the reorientation of the sheet has been accomplished.

Figure 17:
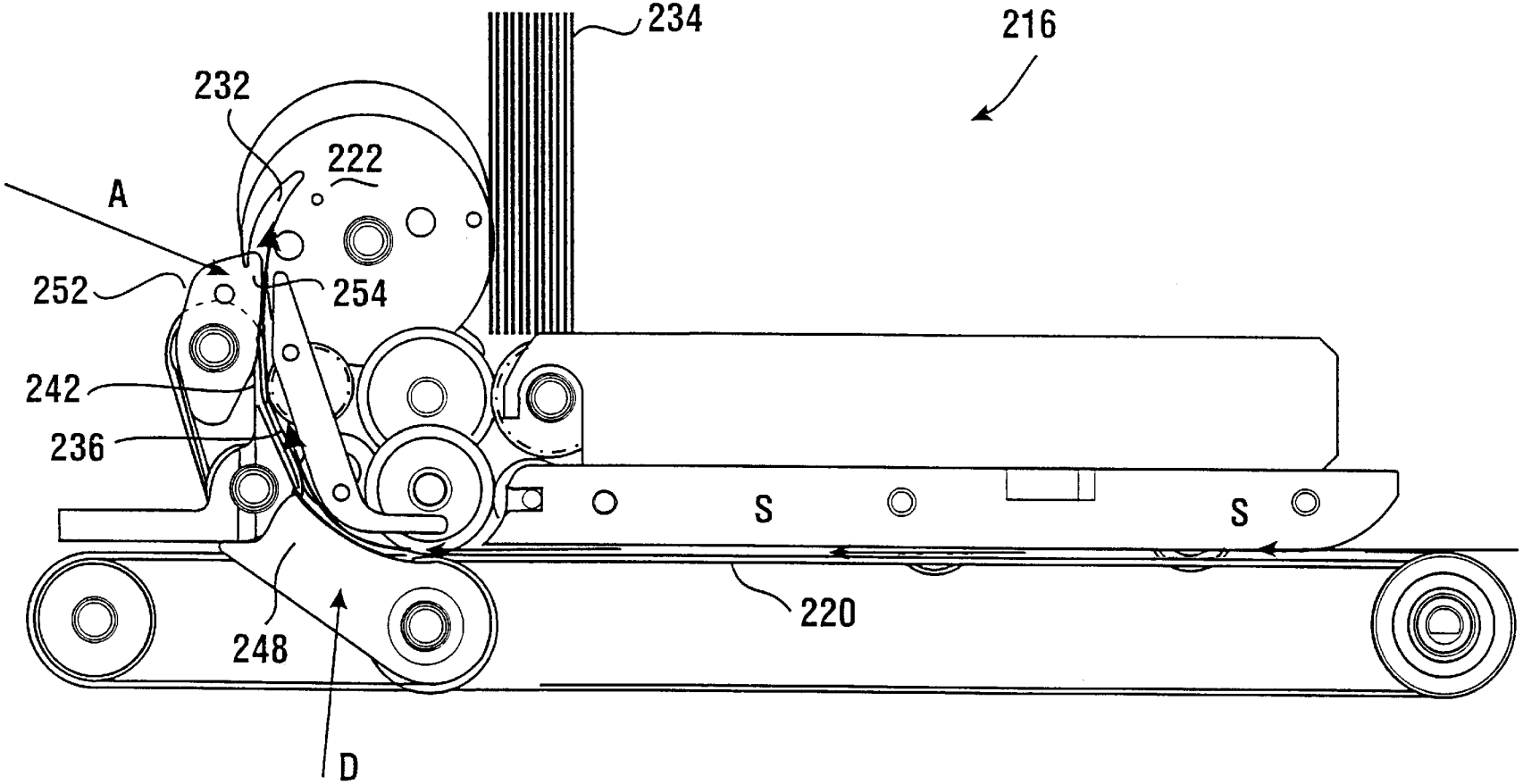
FIG. 17 is a view of the recycling mechanism shown in FIG. 16 accepting a sheet from the main sheet path for storage in a stack associated with the recycling mechanism.

When sheets are to be stored in the recycling mechanism 216 the controller operates appropriate drives or other moving mechanisms to move the diverter 248 upward as shown in the direction of arrow D in FIG. 17. As a result of moving the diverter 248 to this position, sheets which are indicated by the arrows S moving in the main sheet path defined by belt flight 220 are directed by the diverter into the incoming sheet path 236. The controller operates such that belt 242 is driven to engage and move the sheets towards the rotating member 222. The controller also operates to rotate the actuator 252 in the direction of arrow A as shown in FIG. 17. In this position, the guide surface 254 of the actuator is positioned to guide and direct incoming sheets into the slot 232 of the rotating member. It should be understood that suitable sheet sensors are also positioned in the incoming sheet path. These sensors which are in operative connection with the controller enable the controller to control the rotation of the rotating member 222 and the movement of the belt 242 to move and store the incoming sheets in the manner shown.

Figure 18:
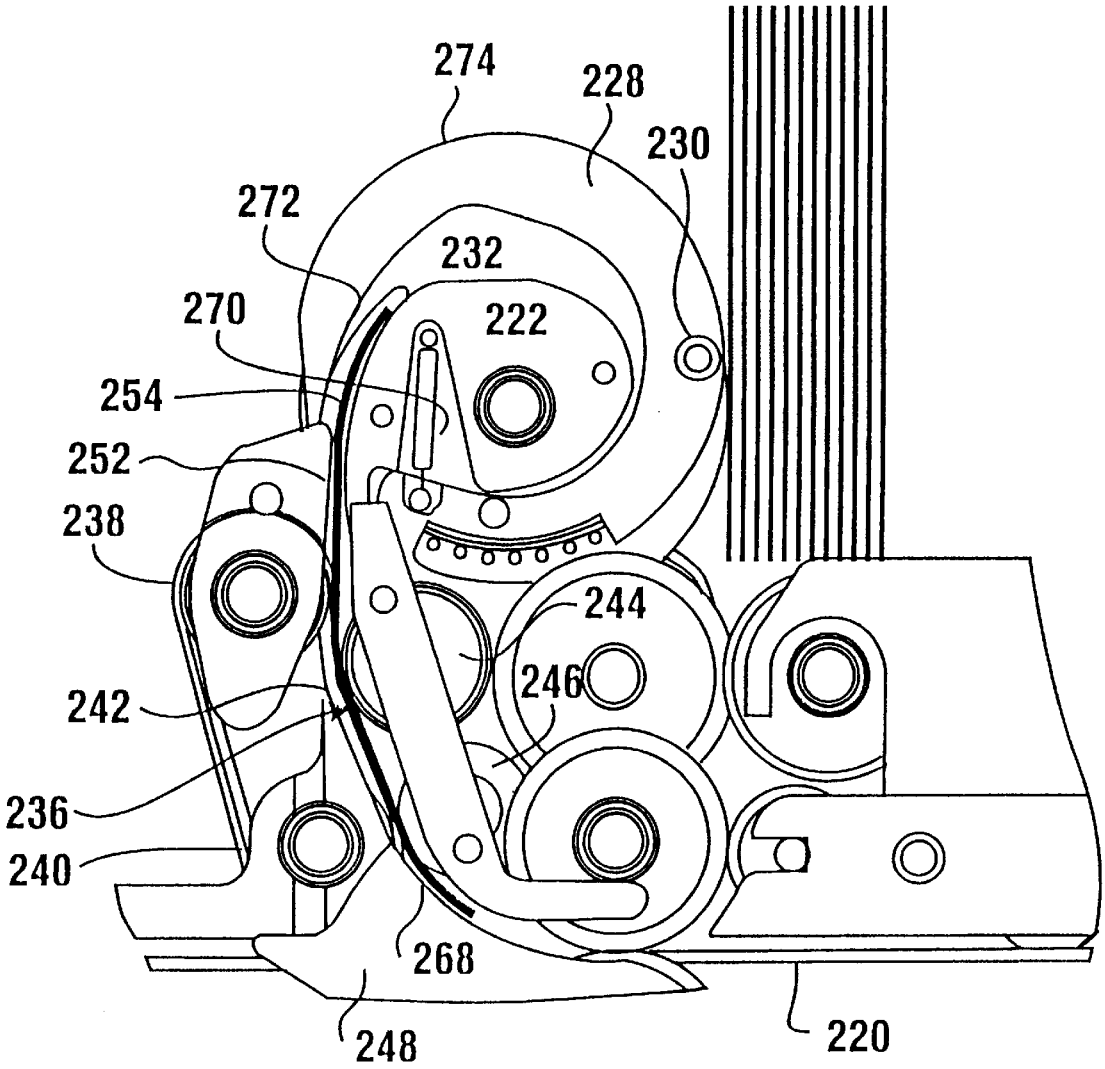
FIG. 18 is a detailed view of the mechanism shown in FIG. 17 showing a sheet engaging a slot in the rotating member.

FIG. 18 shows a sheet 268 moving to engage the rotating member 222 in the incoming sheet path. In the rotational position of the rotating member 222 shown in FIG. 18, a spring schematically indicated 270 operates to bias the moveable member 228 to a position in which the sheet may enter the slot 232. A gripper portion 272 which in the exemplary embodiment is comprised of an inner surface of the moveable member 228, is disposed radially outward relative to the slot so that the sheet 268 may enter therein. In the position of the moveable member shown, a gripper actuating surface 274 is operative to extend radially outward beyond the surface of the rotating member 222.

Responsive to the sensor or other appropriate device sensing the sheet 268 moving into the slot 232, the computer is operative to cause the rotating member 222 to begin moving in a clockwise direction. As a result, the rotating member moves to the position shown in FIG. 19. In this position the gripper actuating surface 274 moves to engage a cam moving surface 276. In the exemplary embodiment the cam moving surface includes a portion of the end sheet bounding the stack 234. Alternatively, if there are no sheets in the stack the cam moving surface may comprise a portion of a surface of a stack supporting member as in the previously described embodiment. The engagement of the gripper actuating surface 274 with the cam moving surface 276 is operative to cause the moveable member 228 to move in the direction indicated by arrow G in FIG. 19. Such movement causes the gripper portion 272 to move inward and engage the sheet 268 in the slot 232. As a result of such engagement, the sheet 268 is engaged with and is moved by the rotating member 222. Also as the sheet moves in engagement with the rotating member towards the stack, the actuator 252 is moved responsive to operation of the controller to dispose the actuator from the rotating member. This is done to enable a picker portion 278 positioned on the moveable member to freely pass the actuator 252. The picker portion 278 which is later discussed in detail includes a resilient high friction portion in the exemplary embodiment. As can be appreciated from FIG. 19 in the position of the moveable member shown, picker portion 278 is disposed outward as the force of the cam moving surface 276 overcomes the force of spring 270. As a result sheet 268 is further held in engagement with the rotating member by the action of the extended picker portion 278.

Figure 19:
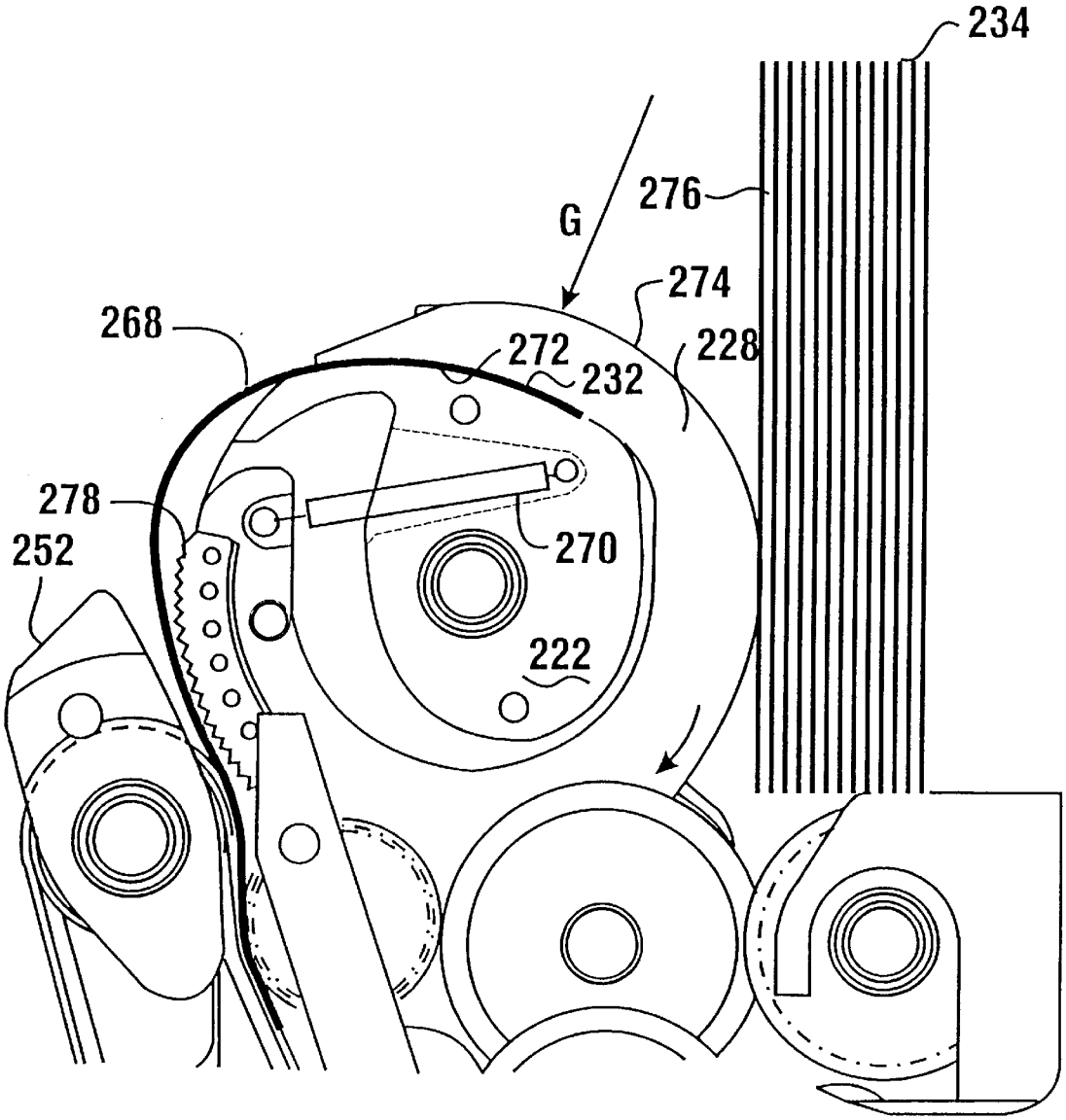
FIG. 19 is a view similar to FIG. 18 with the rotating member rotating clockwise as shown and moving the engaged sheet towards the stack.
Figure 20:
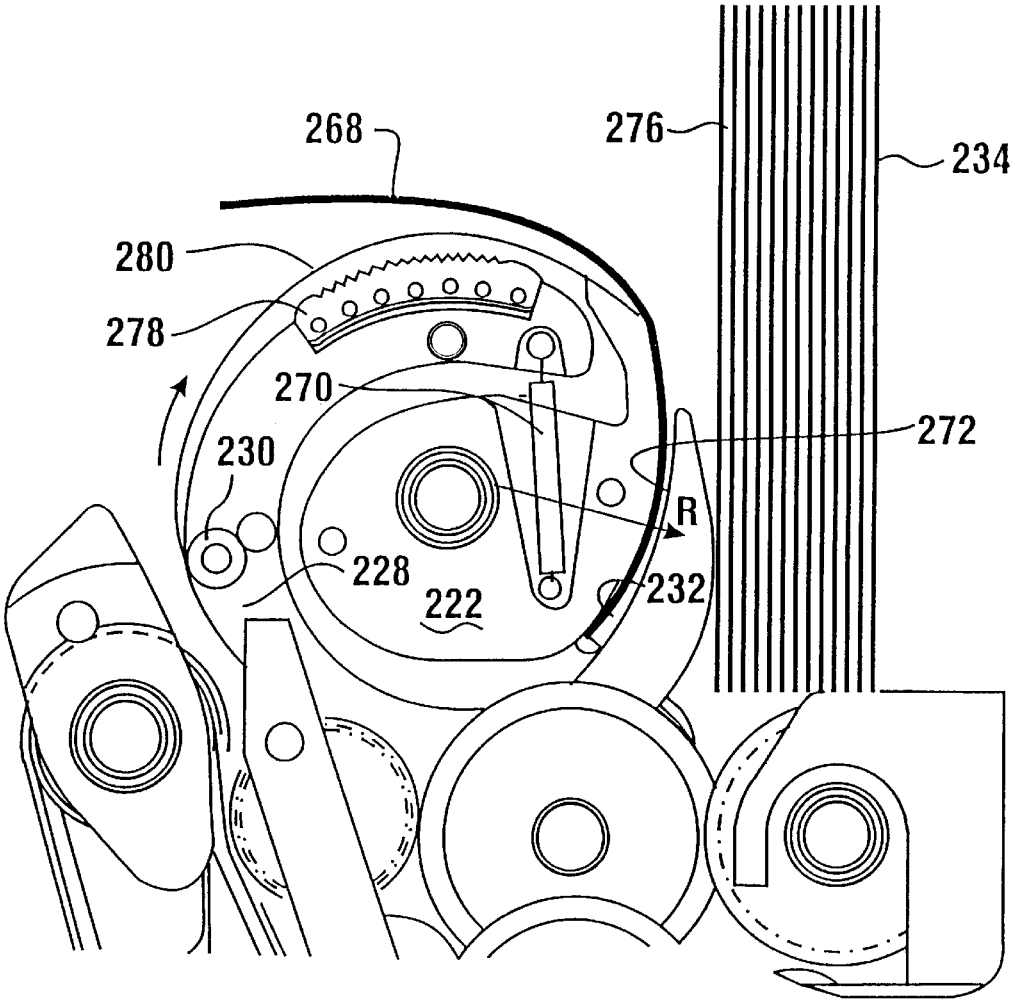
FIG. 20 is a view similar to FIG. 19 with the rotating member shown further rotated in a clockwise direction to a position where the note disengages from the rotating member.

The controller continues to operate to cause the rotating member 222 to rotate in a clockwise direction from the position shown in FIG. 19. Such clockwise rotation brings the rotating member to the position shown in FIG. 20. In the position shown in FIG. 20, the gripper actuating surface 274 has moved so that it is no longer engaged with cam moving surface 276. As a result the moveable member 228 moves responsive to the force of spring 230. This causes gripper portion 272 to again open slot 232. Likewise, picker portion 278 is moved inward relative to the adjacent outer surface 280 of rotating member 222. This enables sheet 268 to move relative to slot 232 and to be disengaged therefrom. As the rotating member continues to rotate in a clockwise direction from the position shown in FIG. 20, sheet 268 is moved by the contour of the rotating member in the direction of arrow R. This causes sheet 268 to be integrated in the stack and to become a new end sheet bounding the stack adjacent to the rotating member.

In the exemplary embodiment of recycling mechanism 216 a plurality of stator members 282 are mounted in supporting connection with shaft 226 and are disposed transversely of the rotating members 222. The Stator members 282 are supported on a common shaft with the rotating members and are stationary relative to the sheets in the stack 234. Stator member 282 includes a stop surface 284. Stop surface 284 is operative to engage sheet 268 in the proper position for the sheet to release from rotating member 222 for purposes of integrating the sheet into the stack.

The stop surface 284 of the stator member 282 includes an end surface 286. End surface 286 extends generally adjacent to the outgoing sheet path 260 along which sheets which are picked from the stack are enabled to pass. As a result the end surface 286 enables sheets picked from the stack in a manner later described to move into the outgoing sheet path.

In the exemplary form of the stator member 282 the stop surface 284 extends in a direction that is both radially outward relative to shaft 226 and the axis thereof, and in the outgoing direction of sheets which move in the outgoing sheet path. This configuration facilitates the passage of sheets as they disengage from the rotating member 222 into engagement with the other sheets in the stack 234.

Figure 21:
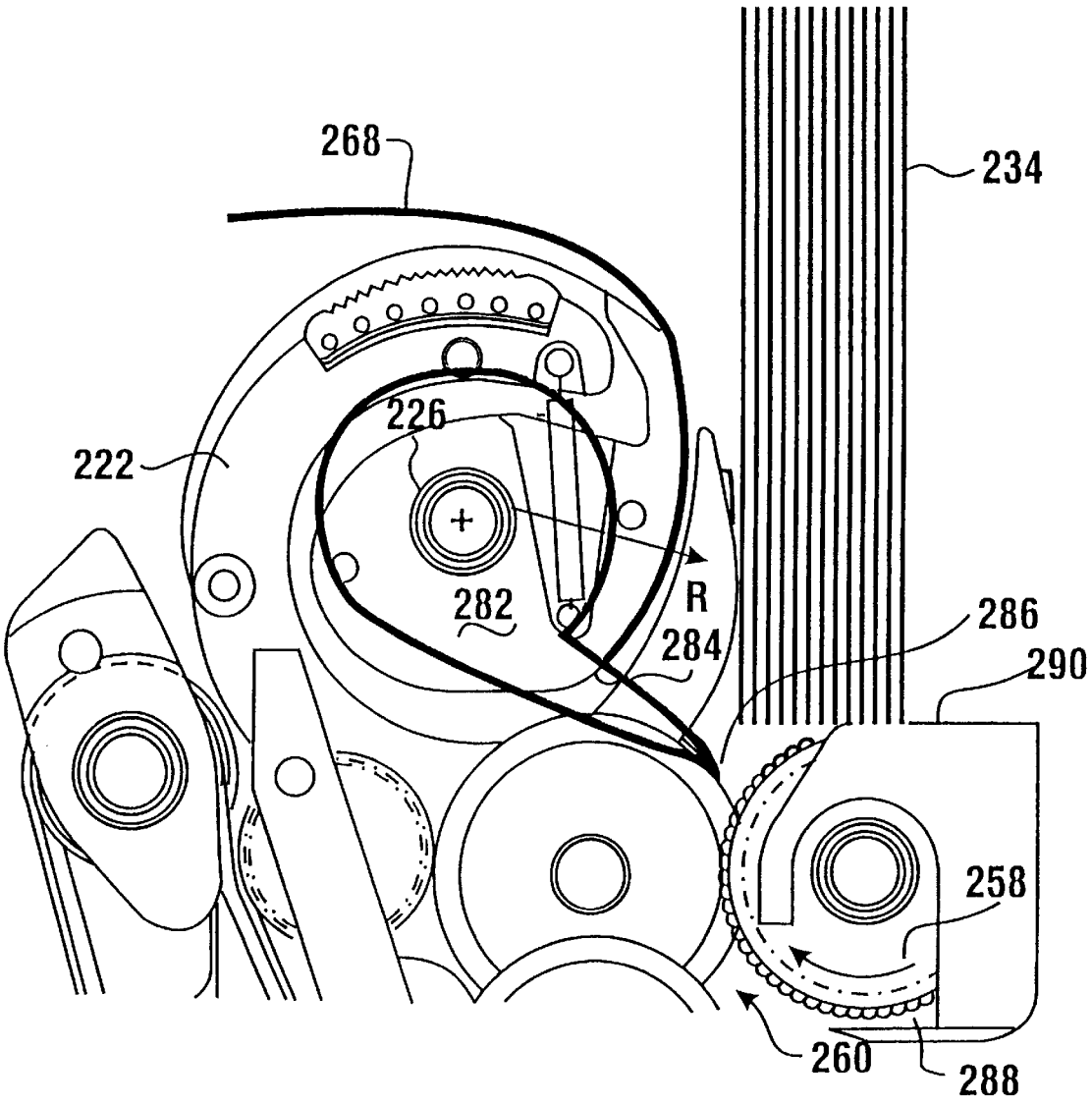
FIG. 21 is a view similar to FIG. 20 showing a stator member coaxially mounted with the rotating member and the stop surface which engages a sheet.

In the exemplary embodiment as incoming sheet 268 is being disengaged from the rotating member 222, stripper rolls 258 are rotated responsive to operation of the controller in the counterclockwise direction as shown in FIG. 21. Such rotation operates to cause sheet 268 as it disengages from the stop surface 284 to be urged upward into the stack 234. In the exemplary form of the recycling mechanism 216, a plurality of non-contact stripper rolls include textured outer surfaces 288. The textured outer surfaces 288 include treadlike structures which engage and facilitate the movement of sheets in response to the rotation thereof. The rotation of the stripper rolls 268 with the textured outer surfaces 288 move the sheet 268 into engagement with the sheets in the stack and into supporting connection with support surface 290 which generally supports the sheets in the stack.

Figure 22:
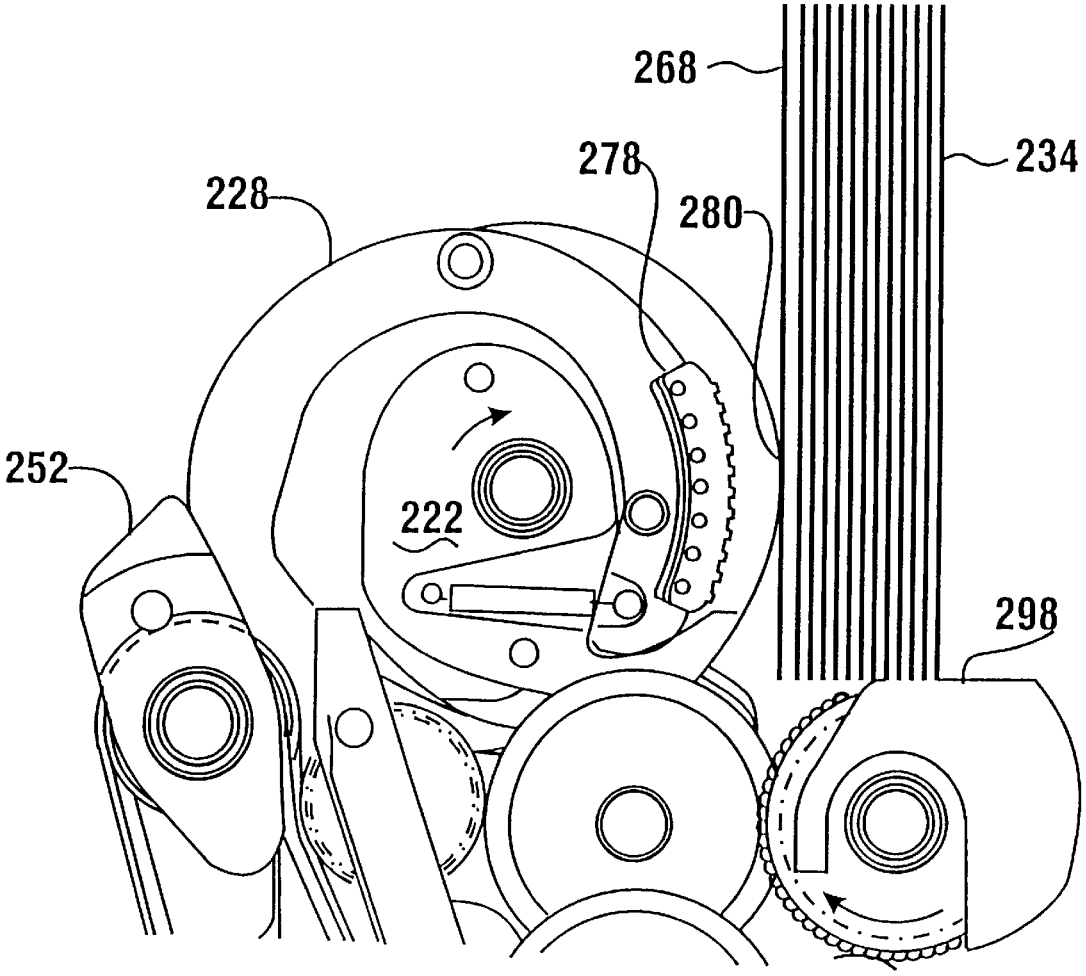
FIG. 22 is a view similar to FIG. 21 with the sheet shown moved into the stack and the rotating member rotated further towards its initial position.
Figure 23:
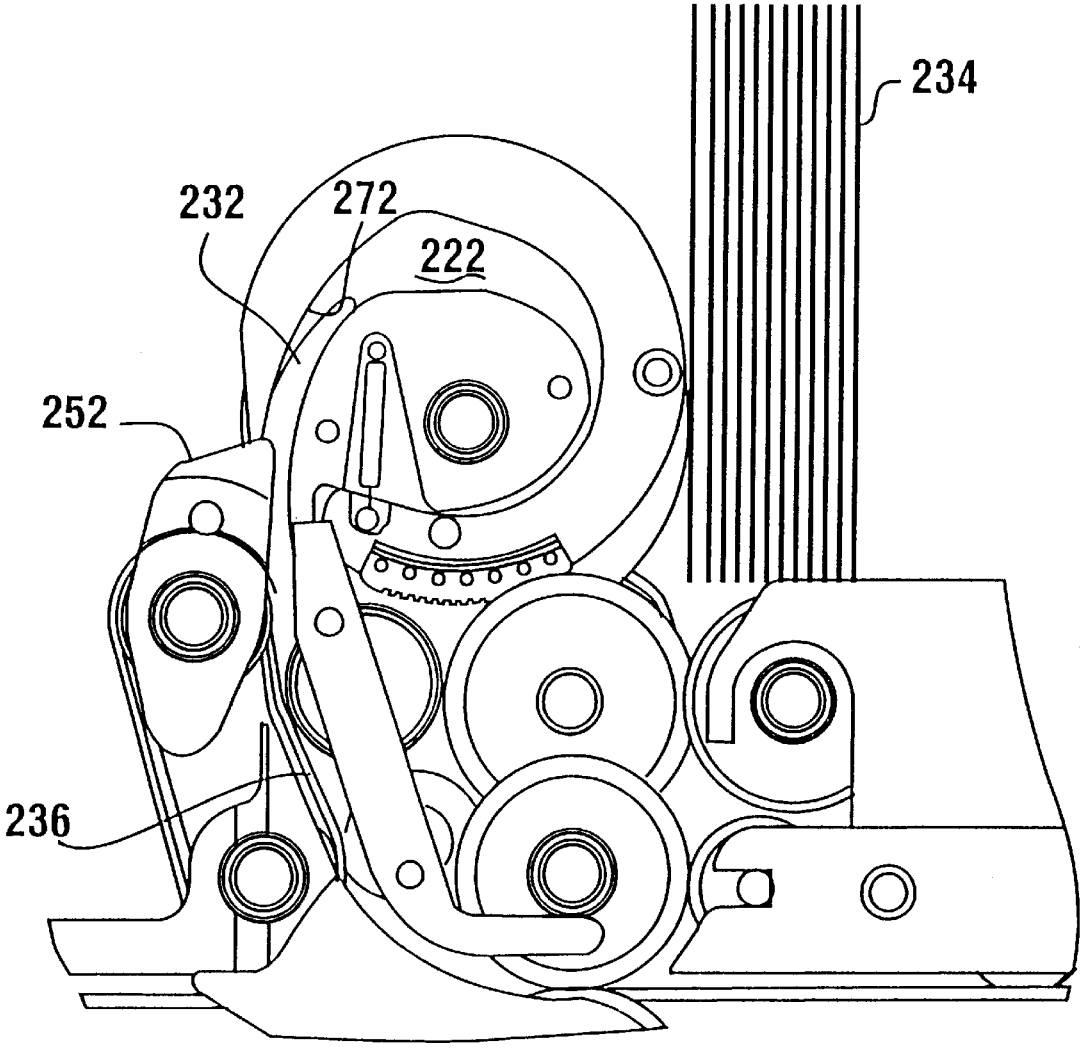
FIG. 23 is a view similar to FIG. 17 showing the rotating member returned to the position to accept another sheet.

As shown in FIG. 22 rotation of the rotating member in a clockwise direction from the position shown in FIG. 21 causes sheet 268 to be disengaged from the rotating member and to be integrated into the stack. In the position of the actuator 252 shown in FIG. 22, the picker portion 278 is retracted radially inward relative to the outer surface 280 of the rotating member. As a result, the picker portion does not engage sheet 268 and generally freely passes the stack 234.

Further rotation of the rotating member 222 returns the rotating member to the home position originally shown in connection with FIG. 18. In this position, the actuator 252 is shown in position to direct additional sheets into the slot 232. The gripper portion 272 is disposed from the slot to enable sheets to move therein. As a result the controller is ready to accept another sheet through the incoming sheet path 236 and to engage such a sheet and move it into the slot 234. Sheets may be repeatedly delivered through the incoming sheet path and added into the stack through repeated rotations of the rotating member 222.

As is the case with the previously described embodiment, recycling mechanism 216 is also enabled to selectively dispense sheets stored in the stack 234. The process by which this is accomplished is now explained with reference to FIGS. 24 through 29. In dispensing sheet a the controller operates to rotate the rotating member 222 to a home position shown in FIG. 24. In this position the rotating member is in abutting relation against an end sheet 292 bounding stack 234. The slot 232 of the rotating member is positioned adjacent to the stack. In the initial position, the actuator 252 is positioned by the controller in a position disposed away from the rotating member. The picking portion 278 on the moveable member 228 is positioned radially inward from the adjacent outer surface 280 by the biasing action of spring 270.

Figure 24:
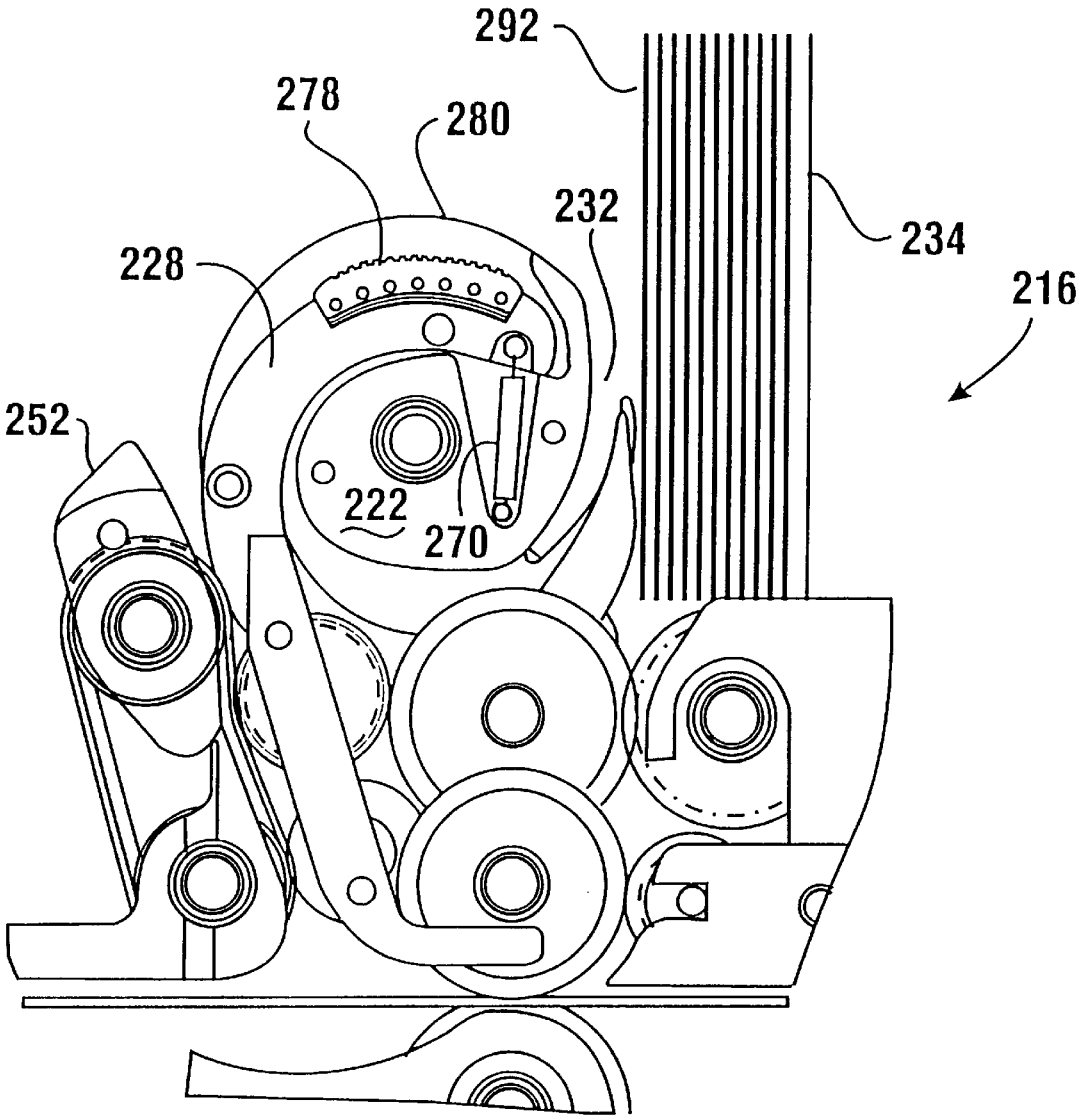
FIG. 24 is a view of the recycling mechanism shown in FIGS. 16 through 23 with the rotating member in a rotational position in preparation for dispensing a sheet.

To commence the picking of sheet 292 the rotating member 222 is rotated in a clockwise direction from the position shown in FIG. 24. Such rotation brings the picking portion 278 adjacent to the sheet 292 to be picked. Such rotation also brings the gripper actuating surface 274 on the opposed side of pivot 230 adjacent to the actuator 252.

Figure 25:
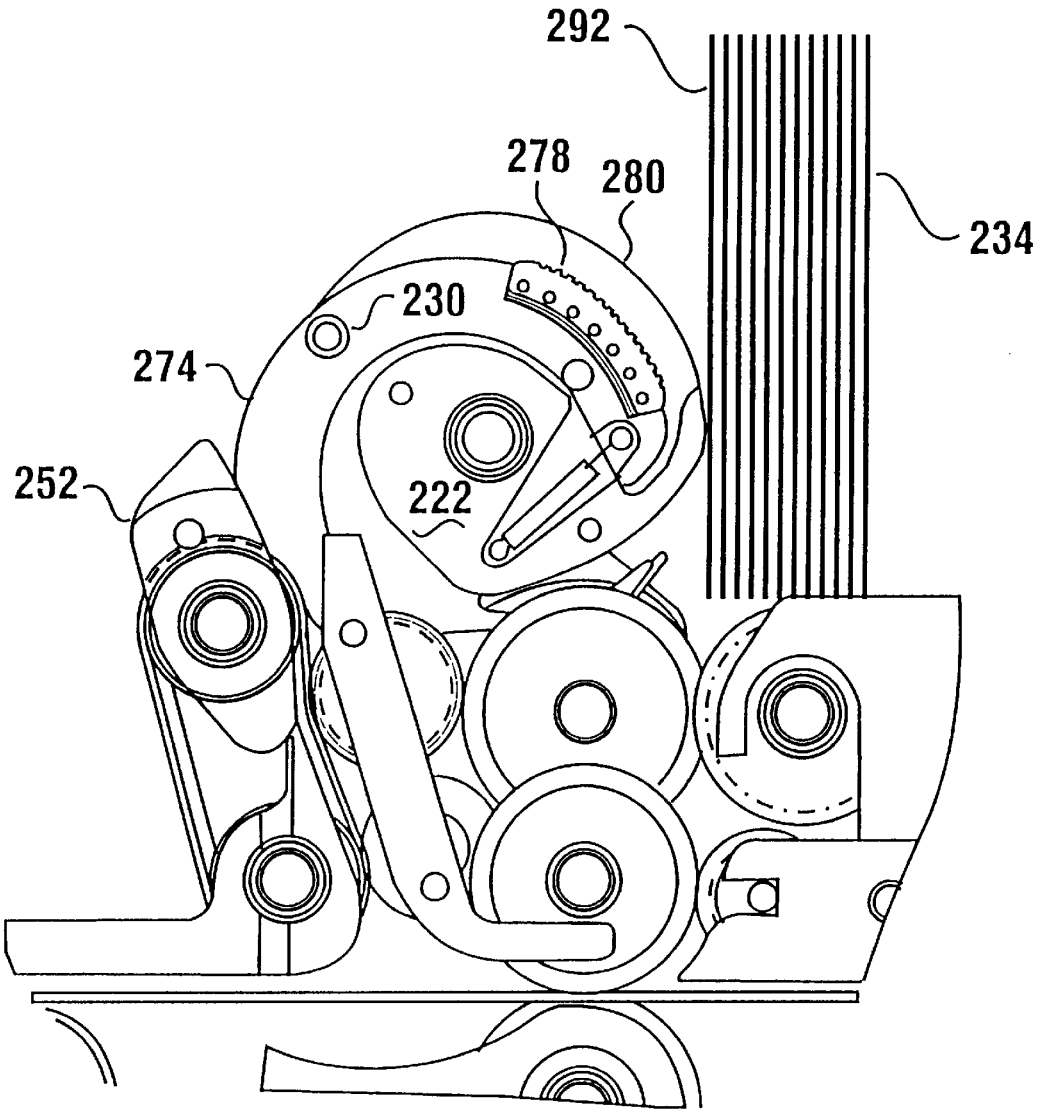
FIG. 25 is a view similar to FIG. 24 with the rotating member moving in a clockwise direction towards a sheet picking position.
Figure 26:
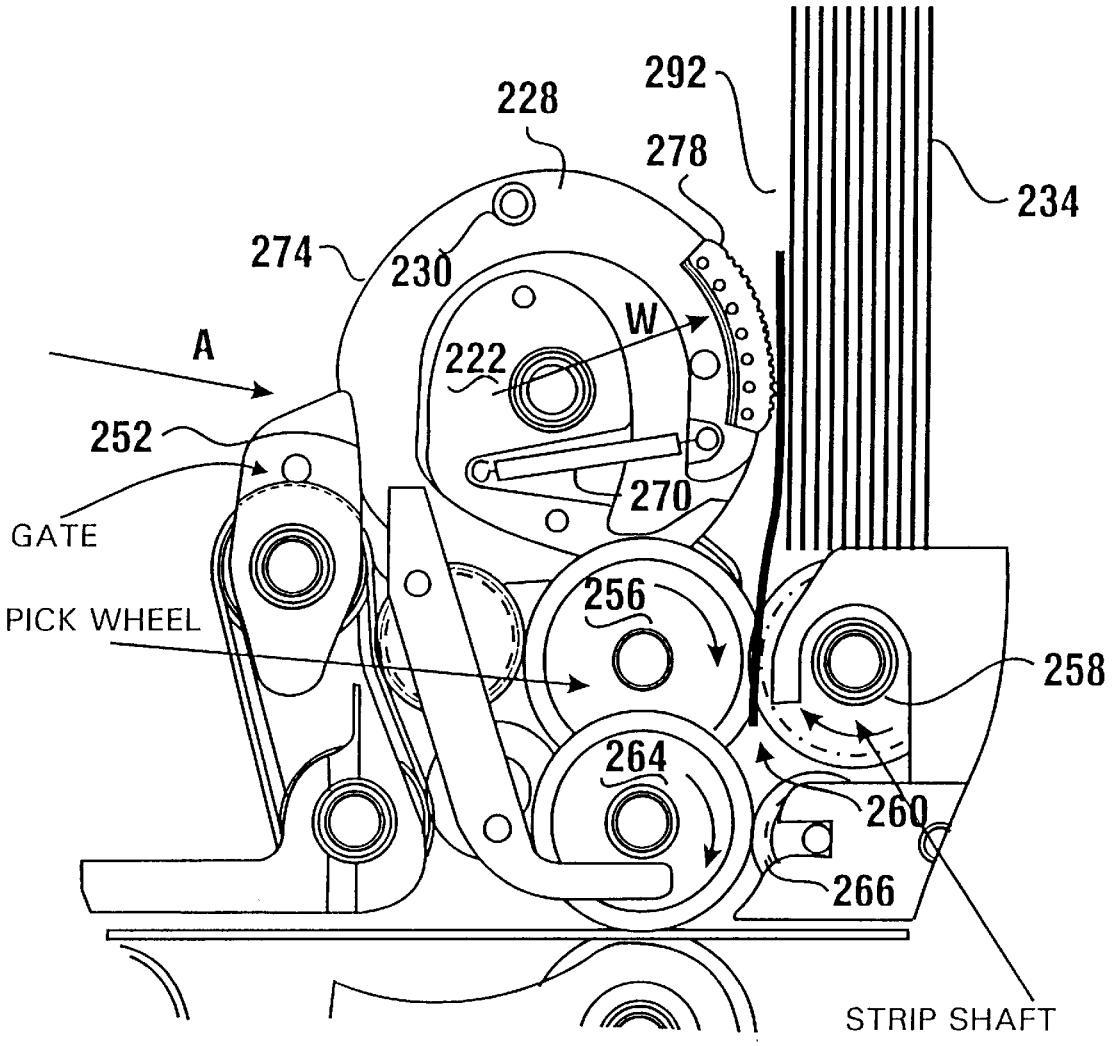
FIG. 26 is a view similar to FIG. 25 with the rotating member shown with a picker portion engaging a sheet to move it from the stack.

With the rotating member 222 in the position shown in FIG. 25, the actuator 252 is moved in the direction of arrow A in FIG. 26. This causes the actuator 252 to engage the gripper actuating surface 274. Engagement of the gripper actuating surface moves the moveable member 228 about the pivot 230. Such movement causes the picking portion 278 to move in the direction of arrow W in FIG. 26. Such movement causes the picking portion 278 to extend radially outward beyond the outer surface 280 of the rotating member. As a result the picking portion 278 engages end sheet 292 and moves it downward from the stack 234.

Movement of the end sheet 292 from the stack causes the sheet to move into the outgoing sheet path between feed rolls 256 and stripper rolls 258. In the exemplary embodiment in the picking of an outgoing sheet, the feed roll moves the sheet generally in an outgoing sheet direction while the stripping roll rotates to urge the sheet in the opposite direction. Because the feed roll applies a greater engaging force the surface of the sheet, the sheet tends to move in the outgoing sheet direction in the sheet path. However, the resistance force applied by the stripper roll causes any other sheets to be separated and moved back towards the stack. This generally assures that only a single sheet moves outward past the feed and stripper rolls in the outgoing sheet path.

Figure 27:
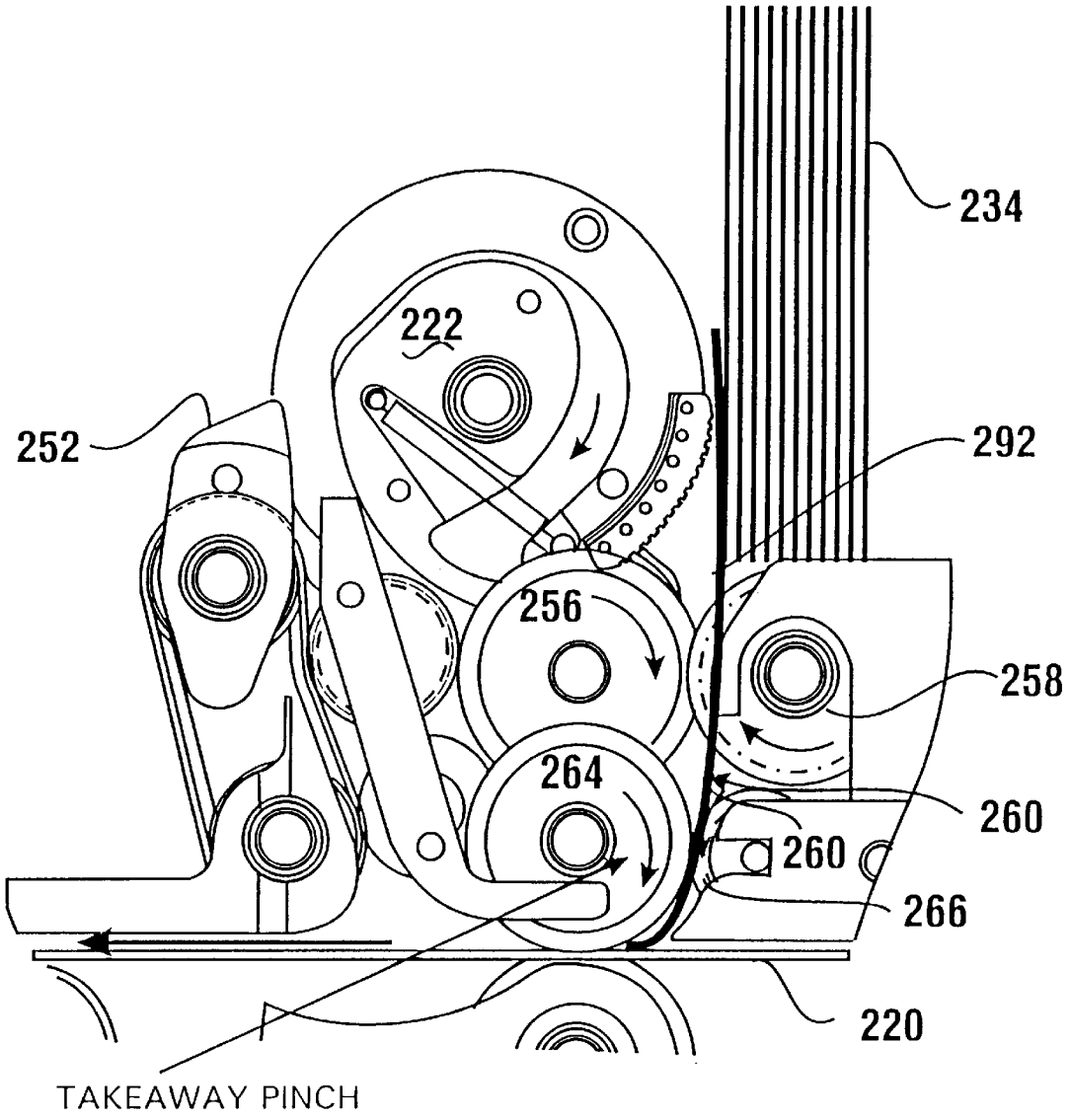
FIG. 27 is a view similar to FIG. 26 with the sheet picked from the stack, moved through the stripper mechanism and into the main sheet path.

As the outgoing sheet begins to move past the feed and stripper rolls, sensing may be conducted as discussed in connection with the previously described embodiment, to determine if a double sheet has been picked. In circumstances where a double sheet is detected, appropriate steps may be taken to return the sheet to the stack or otherwise route the sheet in an appropriate manner. Assuming that the outgoing sheet is not to be returned to the stack due to the presence of a double or other condition, the sheet is moved in the outgoing sheet path to engage the take away rolls 264 and 266. As shown in FIG. 27, the take away rolls 264 and 266 are driven to engage the sheet and to move it into the main sheet path bounded by belt flight 220. In the exemplary embodiment the take away rolls engage the sheet as the rotating member 222 continues rotating in a clockwise direction as shown to urge the sheet away from the stack.

Figure 28:
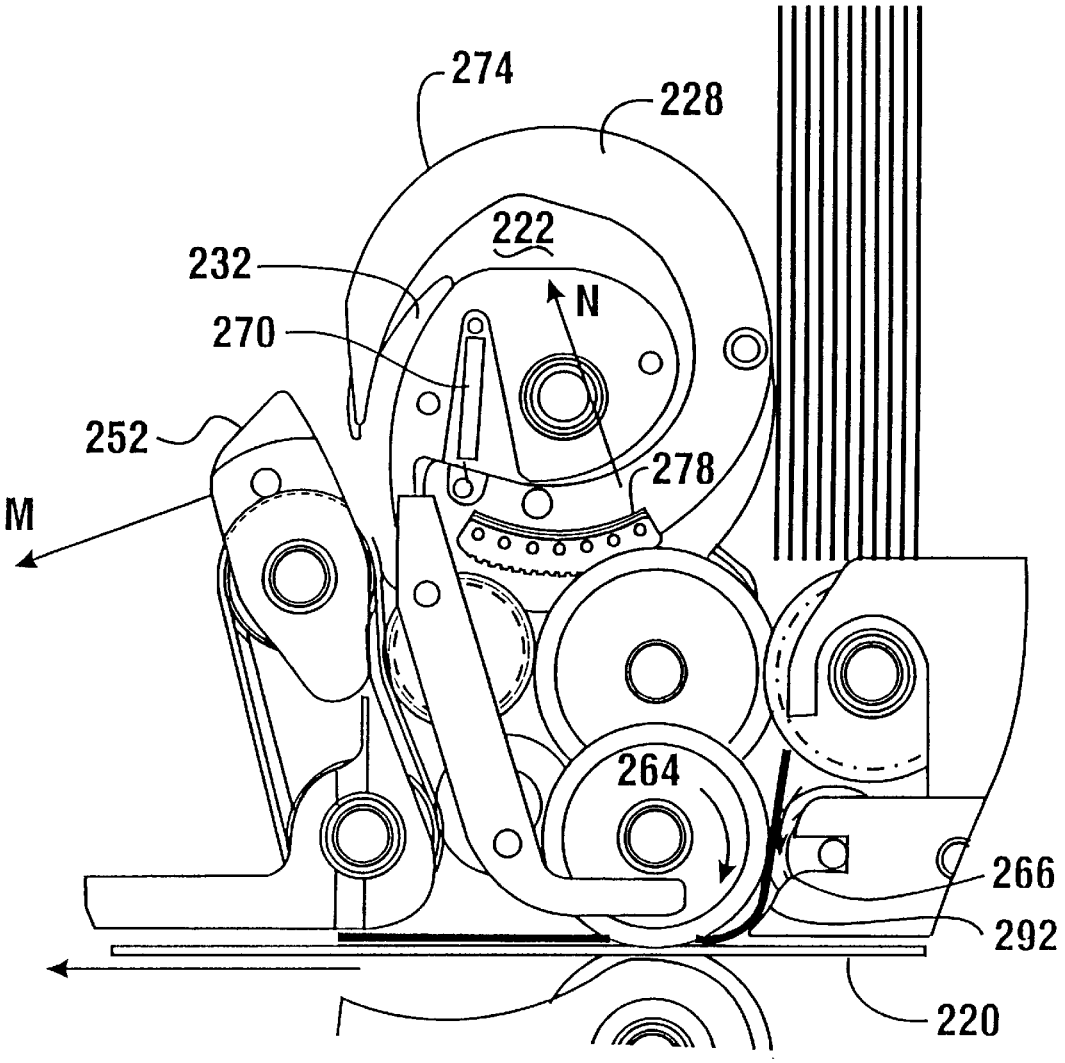
FIG. 28 is a view similar to FIG. 27 showing the sheet picked from the stack moving in the main sheet path and the rotating member rotating towards its home position for purposes of picking a sheet.

As shown in FIG. 28, sheet 292 is eventually disposed from the stack and is carried into the main sheet path by the operation of take away rolls 264, 266. As this occurs the rotating member 222 continues to rotate in a clockwise direction. As the gripper actuating surface 274 of the moveable member 228 reaches the termination area thereof adjacent to slot 232, the controller operates to move the actuator 252 in the direction of arrow M shown in FIG. 28. This disposes the actuating member away from the rotating member 222. This also results in the picker portion 278 being retracted in the direction of arrow N in response to the biasing force applied by spring 270.

Figure 29:
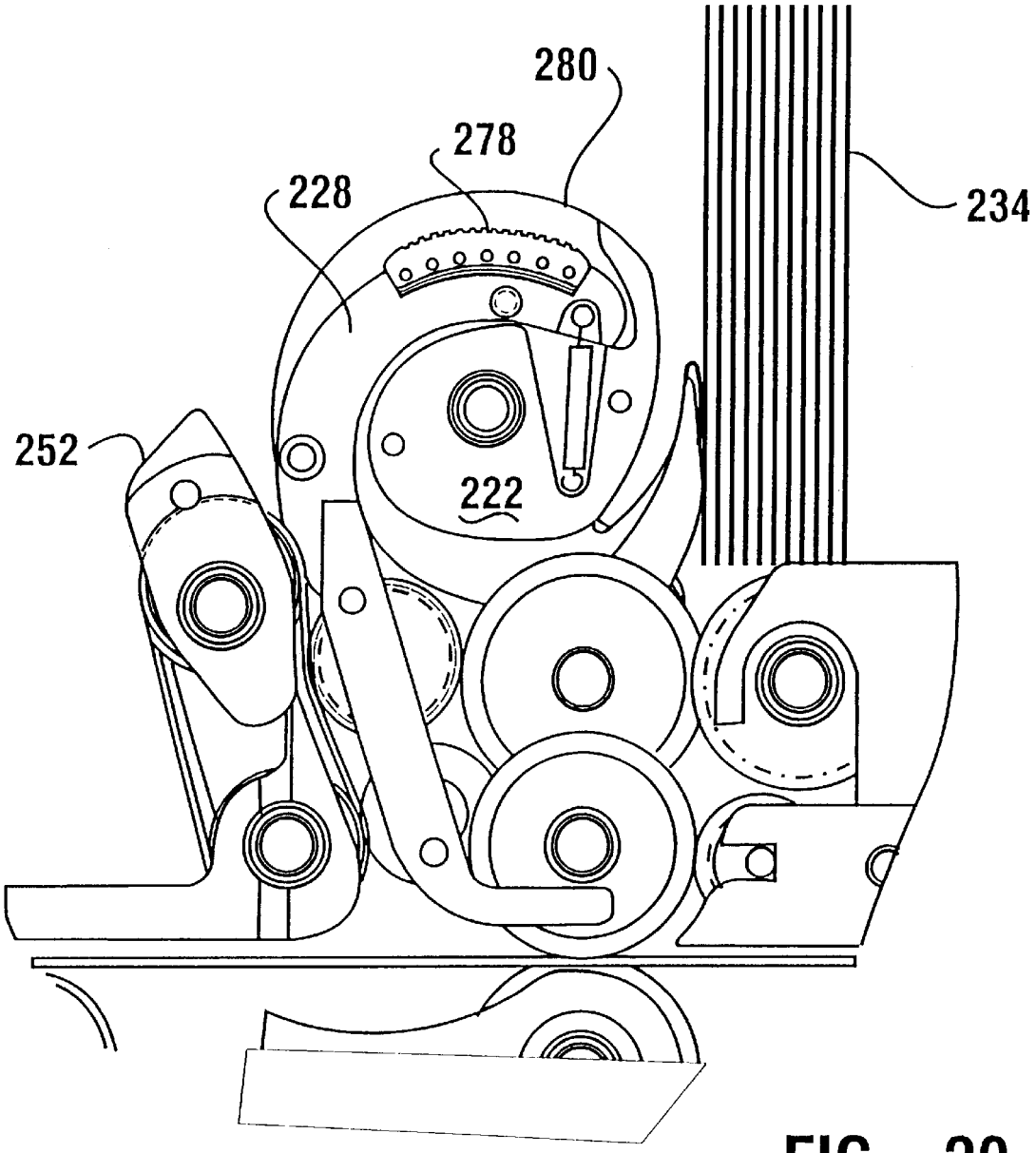
FIG. 29 is a view similar to FIG. 28 with the rotating member shown rotated to its home position for picking a sheet from the stack.

Further rotation of the rotating member 222 in the clockwise direction from the position shown in FIG. 28 brings the rotating member to the home position for picking sheets as shown in FIG. 29. In this position the rotating member 222 is in the same position as shown in FIG. 24. In this position the picker portion 278 is again radially moved inward relative to the outer surface 280 of the rotating member. From this position the rotating member 222 may be rotated by the controller clockwise to dispense another sheet from the stack 234. Alternatively, if the automated banking machine needs to accept additional sheets into the stack the controller may operate to rotate the rotating member 222 clockwise without the actuating member 252 moving the picker portion 278 to engage the stack. In this way the rotating member may be brought to the position shown in FIG. 17 so that additional sheets may be accepted into the stack.

It should be understood that while in this exemplary embodiment separate incoming sheet paths and outgoing sheet paths are used, in alternative embodiments the rotating member may be operated to both receive and dispense sheets into a single sheet path. Further, it should be understood that while in this exemplary configuration each set of rotating members is associated with a single stack, other embodiments may operate such that a single rotating member may both deposit and pick sheets from multiple stacks adjacent thereto. Finally, it should be further understood that while the gripper portion and picker portion of the exemplary embodiment are connected to a common moveable member that moves relative to the rotating member, in other embodiments separate gripper and picker members may be included in operative connection with the rotating member to perform their respective functions.

As can be appreciated from the foregoing description, the exemplary forms of the sheet media storage and dispensing system of the described embodiments of the present invention involves few moving parts and is relatively economical to produce and operate. Further the described embodiments of the invention are highly reliable and enable operating at high speeds. Embodiments of the invention may also be used to store and retrieve large numbers of notes in storage mechanisms and recycling mechanisms.

It should be understood that while two recycling mechanisms are shown in the exemplary automated banking machine described herein, other embodiments of the invention may include additional recycling mechanisms. In addition recycling mechanisms may be provided for several denominations of notes or other sheets which a machine is likely to receive, and which may be distributed to customers. Recycling mechanisms may be used in machines without separate storage mechanisms. Likewise machines with storage mechanisms may be constructed without recycling mechanisms. Machines may be controlled to transfer sheets between recycling mechanisms or between recycling and storage mechanisms to redistribute sheets within the machine. The particular type and nature of the mechanisms used and how they are operated will depend on the particular type of automated banking machine.

Thus the new media storage system of the described embodiments of the present invention achieve the above stated objectives, eliminate difficulties encountered in the use of prior devices and systems, solve problems and attain the desirable results described herein.

In the foregoing description certain terms have been used for brevity, clarity and understanding, however no unnecessary limitations are to be implied therefrom because such terms are for descriptive purposes and are intended to be broadly construed. Moreover, the descriptions and illustrations herein are by way of examples and the invention is not limited to the exact details shown and described.

In the following claims any features described as a means for performing a function shall be construed as encompassing any means known to those skilled in the art as capable of performing the recited function, and shall not be deemed limited to the particular means shown herein performing such functions, or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations and relationships are set forth in the appended claims.

We claim:

1. An automated banking machine apparatus comprising:

a frame;

a sheet moving mechanism in supporting connection with the frame, wherein the sheet moving mechanism is operative to move sheets in a first direction along a sheet path;

a flipper member in supporting connection with the frame and rotatably movable relative thereto about an axis extending generally normal to the first direction, wherein the flipper member includes a peripherally extending slot sized to accept a sheet therein, and wherein in an engaging position of the flipper member the slot is positioned to engage a sheet moving in the sheet path;

a gripper member, wherein the gripper member is movably mounted in supporting connection with the flipper member, wherein the gripper member is movable in a recess in the flipper member extending generally perpendicular relative to the slot, between a first position wherein a sheet in the slot is held in relatively fixed engagement with the flipper member, and a second position wherein a sheet in the slot is enabled to move relative to the flipper member;

a stop surface adjacent the flipper member, wherein a projection of the stop surface in a direction generally parallel to the axis intersects the slot when the flipper member is in a releasing position rotationally disposed from the engaging position; and a moving mechanism in operative connection with the flipper member, wherein the moving mechanism is operative to cause the flipper member to move between the engaging and releasing positions, and the gripper member to move from the second position to the first position when the flipper member is generally in the engaging position, and from the first position to the second position when the flipper member is generally in the releasing position, wherein a sheet moving in the sheet path is engaged with the moving flipper member in the engaging position and released in abutting relation to the stop surface.

2. The apparatus according to claim 1 wherein the moving mechanism comprises a cam moving surface adjacent to the flipper member, wherein the cam moving surface is operative to move the gripper member between the first and second positions as the flipper member moves between the engaging and releasing positions.

3. The apparatus according to claim 1 wherein the gripper member is rotatable relative to the flipper member about a pivot, and wherein the pivot is angularly disposed on the flipper member relative to the slot.

4. The apparatus according to claim 1 wherein the slot includes an arcuate portion.

5. The apparatus according to claim 1 wherein the slot terminates at an inward portion, wherein the inward portion extends generally normal to the stop surface when the flipper member is in the releasing position.

6. The apparatus according to claim 1 and further comprising a stack member, wherein the stack member is in supporting connection with the frame, and wherein the stack member is movable relative to the flipper member and the stop surface in a direction generally radially away from the axis.

7. The apparatus according to claim 6 and further comprising a biasing member in operative connection with the stack member, and wherein the biasing member is operative to bias the stack member in an opposed direction, wherein the opposed direction extends generally radially toward the axis.

8. The apparatus according to claim 7 and further comprising a sheet moving in the sheet path, wherein movement of the flipper member between the engaging and releasing positions is operative to move the sheet adjacent to the stop surface and in intermediate relation between the stack member and the flipper member.

9. The apparatus according to claim 1 and further comprising a guide member, wherein the guide member is movably mounted in supported relation with the frame, and wherein the guide member is movable between a directing position and a passing position, wherein in the directing position the guide member is operative to direct a sheet moving in the sheet path to engage the slot in the flipper member, and wherein in a passing position the guide member is operative to enable a sheet to move past the flipper member in the sheet path.

10. The apparatus according to claim 9 and further comprising:

a first module;

wherein the first module includes the guide member and the flipper member, and wherein the first module is selectively operative to accept sheets from the sheet path, and further comprising a second module similar to the first module, wherein the second module is disposed adjacent to the sheet path; and a control system in operative connection with the first and second modules, wherein the control system is selectively operative to direct sheets in the sheet path to the first or second modules.

11. The apparatus according to claim 1 wherein the peripherally extending slot of the flipper member includes an arcuate spiral portion.

12. An automated banking machine apparatus comprising:

a frame;

a sheet moving mechanism in supporting connection with the frame, wherein the sheet moving mechanism is operative to move sheets along a sheet path;

a flipper member in supporting connection with the frame and rotatably movable relative thereto about an axis, wherein the flipper member includes a peripherally extending slot sized to accept a sheet therein, and wherein in an engaging position of the flipper member the slot is positioned to engage a sheet extending in the sheet path;

a gripper member, wherein the gripper member is movably mounted in supporting connection with the flipper member, wherein the gripper member is movable relative to the slot between a first position wherein a sheet in the slot is held in relatively fixed engagement with the flipper member, and a second position wherein a sheet in the slot is enabled to move relative to the flipper member;

a stop surface adjacent the flipper member, wherein a projection of the stop surface in a direction generally parallel to the axis intersects the slot when the flipper member is in a releasing position rotationally disposed from the engaging position;

a sheet disposed adjacent to the stop surface, wherein the sheet includes a cam moving surface, and wherein the cam moving surface is operative to cause the gripper member to move between the first and second positions when the flipper member moves between the engaging and releasing positions;

a moving mechanism operative to cause the flipper member to move between the engaging and releasing positions, whereby a sheet engaged with the flipper member in the engaging position is released adjacent to the stop surface.

13. The apparatus according to claim 12 and further comprising a biasing mechanism, wherein the sheet is disposed in operative relation between the biasing mechanism and the flipper member, and wherein the biasing mechanism is operative to bias the cam moving surface toward the flipper member.

14. The apparatus according to claim 13 wherein the biasing mechanism includes a stack member, wherein the stack member extends in a direction generally normal to the stop surface, and wherein the stack member is operative to bias the cam moving surface toward the flipper member.

15. An automated banking machine apparatus comprising:

a frame;

a sheet moving mechanism in supporting connection with the frame, wherein the sheet moving mechanism is operative to move sheets along a sheet path;

a flipper member in supporting connection with the frame and rotatably movable relative thereto about an axis, wherein the flipper member includes a peripherally extending slot sized to accept a sheet therein, and wherein in an engaging position of the flipper member the slot is positioned to engage a sheet extending in the sheet path;

a gripper member, wherein the gripper member is movably mounted in supporting connection with the flipper member, wherein the gripper member is movable relative to the slot between a first position wherein a sheet in the slot is held in relatively fixed engagement with the flipper member, and a second position wherein a sheet in the slot is enabled to move relative to the flipper member;

a stop surface adjacent the flipper member, wherein a projection of the stop surface in a direction generally parallel to the axis intersects the slot when the flipper member is in a releasing position rotationally disposed from the engaging position; and a stack member, wherein the stack member extends in a direction generally normal to the stop surface, and wherein the stack member includes a cam moving surface, and wherein the cam moving surface is operative to cause the gripper member to move between the first and second positions when the flipper member moves between the engaging and releasing positions;

a moving mechanism operative to cause the flipper member to move between the engaging and releasing positions, whereby a sheet engaged with the flipper member in the engaging position is released adjacent to the stop surface.

16. The apparatus according to claim 15 and further comprising a biasing member in operative connection with the stack member, and wherein the biasing member is operative to bias the cam moving surface toward the flipper member.

17. The apparatus according to claim 16 and further comprising a sheet, wherein the sheet is moved in engagement with the flipper member from the sheet path to a position in abutting relation with the stop surface and intermediate of the stack member and the flipper member, and wherein the sheet includes the cam moving surface.

18. An automated banking machine apparatus comprising:

a frame;

a sheet moving mechanism in supporting connection with the frame, wherein the sheet moving mechanism is operative to move sheets in a first direction along a sheet path;

a flipper member in supporting connection with the frame and rotatably movable relative thereto about an axis extending generally normal of the first direction, wherein the flipper member includes a radially extending recess extending inward from an outer surface of the flipper member and a peripherally extending slot sized to accept a sheet therein, and wherein in an engaging position of the flipper member the slot is positioned to engage a sheet extending in the sheet path;

a gripper member, wherein the gripper member extends in the radially extending recess and is movably mounted in supporting connection with the flipper member, wherein the gripper member includes a gripper portion that is movable relative to the slot between a first position wherein the gripper portion is moved radially inward such that a sheet in the slot is held in relatively fixed engagement with the flipper member by engagement with the gripper portion, and a second position wherein a sheet in the slot is enabled to move relative to the flipper member as a result of the gripper portion being disposed radially outward relative to the radial position thereof in the first position;

a stop surface adjacent the flipper member, wherein a projection of the stop surface in a direction generally parallel to the axis intersects the slot when the flipper member is in a releasing position rotationally disposed from the engaging position;

a cam moving surface adjacent the flipper member wherein the cam moving surface is operative to cause the gripper member to move in a radial direction relative to the axis in the radially extending recess between the first and second positions when the flipper member moves between the engaging and releasing positions;

a moving mechanism operative to cause the flipper member to move between the engaging and releasing positions, whereby a sheet engaged with the flipper member in the engaging position is released adjacent the stop surface.

19. The apparatus according to claim 18 wherein the flipper member is bounded outwardly adjacent the radially extending recess by an outer flipper surface, and wherein the gripper member includes an outer gripper surface, and wherein in the first position of the gripper member the outer flipper surface and the outer gripper surface are generally in transverse alignment.

20. The apparatus according to claim 19 wherein the cam moving surface is in operative engagement with the outer gripper surface in the first position of the gripper member.

21. The apparatus according to claim 18 wherein the gripper member is rotatably mounted relative to the flipper member.

22. An automated banking machine apparatus comprising:

a frame;

a sheet moving mechanism in supporting connection with the frame, wherein the sheet moving mechanism is operative to move sheets along a sheet path;

a flipper member in supporting connection with the frame and rotatably movable relative thereto about an axis, wherein the flipper member includes a peripherally extending slot sized to accept a sheet therein, and wherein in an engaging position of the flipper member the slot is positioned to engage a sheet extending in the sheet path;

at least one flexible flap in operative connection with the flipper member;

a gripper member, wherein the gripper member is movably mounted in supporting connection with the flipper member, wherein the gripper member is movable relative to the slot between a first position wherein a sheet in the slot is held in relatively fixed engagement with the flipper member, and a second position wherein a sheet in the slot is enabled to move relative to the flipper member;

a stop surface adjacent the flipper member, and a sheet in generally abutting relation with the stop surface, wherein a projection of the stop surface in a direction generally parallel to the axis intersects the slot when the flipper member is in a releasing position rotationally disposed from the engaging position; and a moving mechanism in operative connection with the flipper member, wherein the moving mechanism is operative to cause the flipper member to move between the engaging and releasing positions, and the gripper member to move from the second position to the first position when the flipper member is generally in the engaging position, and from the first position to the second position when the flipper member is generally in the releasing position, and wherein the flap is operative to engage the sheet when the slot is disposed therefrom.

23. An automated banking machine apparatus comprising:

a generally cylindrical flipper member including an arcuate extending slot, wherein the slot terminates inwardly at an inward portion, the flipper member rotatable about an axis and further including a radially extending recess, the recess extending inward from an outer surface of the flipper member and generally perpendicular to the slot; and a gripper member rotationally mounted in supporting connection with the flipper member, wherein the flipper member includes a gripper portion that is radially movable in the recess between a first position, wherein in the first position the gripper portion is moved radially inward such that a sheet moving generally normal to the axis in the slot is held in fixed engagement with the flipper member through engagement with the gripper portion, and a second position wherein a sheet is movable relative to the flipper member in the slot as a result of the gripper portion being disposed radially outward relative to the radial position thereof in the first position.

24. The apparatus according to claim 23 wherein the gripper member is rotatable relative to the flipper member about a pivot, and wherein the pivot is angularly disposed relative to the inward portion of the slot.

25. The apparatus according to claim 24 wherein the gripper member is bounded radially outwardly by an outer gripper surface, wherein in the first position the outer gripper surface is in a first gripper location relative to the recess, and in the second position the outer gripper surface is in a second gripper location which is disposed further radially outward relative to the first gripper location.

26. The apparatus according to claim 23 and further comprising:

a moving mechanism, wherein the moving mechanism is operative to rotate the flipper member about an axis;

a stop surface extending adjacent to the flipper member, wherein a projection of the stop surface intersects the inward portion of the slot in a releasing rotational position of the flipper member; and a releasing mechanism, wherein the releasing mechanism is operative to move the gripper member from the first position to the second position when the flipper member is adjacent to the releasing position.

27. The apparatus according to claim 26 and further comprising an engaging mechanism, wherein the engaging mechanism is operative to move the gripper member from the second position to the first position adjacent an engaging rotational position of the flipper member, wherein the engaging position is angularly disposed from the releasing position.

28. The apparatus according to claim 27 wherein the engaging mechanism comprises a cam moving surface disposed adjacent the flipper member, and the releasing mechanism comprises a biasing member, wherein the biasing member biases the gripper member toward the second position, wherein in the engaging position of the flipper member the force of the cam moving surface overcomes the force of the biasing member to move the gripper member to the first position.

29. The apparatus according to claim 28 and further comprising a sheet moving mechanism, wherein the sheet moving mechanism is operative to move sheets along a sheet path, wherein in the engaging position of the flipper member, the flipper member is operative to engage a sheet in the sheet path in the slot of the flipper member.

30. The apparatus according to claim 29 and further comprising a stack member adjacent the flipper member and extending in a direction generally normal of the stop surface, and wherein upon rotation of the flipper member to the releasing position the sheet is moved to a storage position intermediate of the flipper member and of the stack member.

31. An automated banking machine apparatus comprising:

a generally cylindrical flipper member including an arcuate extending slot, wherein the slot terminates inwardly at an inward portion, the flipper member further including a radially extending recess;

a gripper member rotationally mounted in supporting connection with the flipper member, wherein the gripper member is movable in the recess between a first position, wherein in the first position a sheet in the slot is held in fixed engagement with the flipper member, and a second position wherein a sheet is movable relative to the flipper member in the slot;

an engaging mechanism, wherein the engaging mechanism is operative to move the gripper member from the second position to the first position adjacent an engaging rotational position of the flipper member, wherein the engaging position is angularly disposed from the releasing position, and wherein the engaging mechanism comprises a cam moving surface disposed adjacent the flipper member;

a moving mechanism, wherein the moving mechanism is operative to rotate the flipper member about an axis;

a stop surface extending adjacent to the flipper member, wherein a projection of the stop surface intersects the inward portion of the slot in a releasing rotational position of the flipper member;

a releasing mechanism, wherein the releasing mechanism is operative to move the gripper member from the first position to the second position when the flipper member is adjacent to the releasing position;

a stack member adjacent the flipper member and extending in a direction generally normal of the stop surface, wherein upon rotation of the flipper member to the releasing position the sheet is moved to a storage position intermediate of the flipper member and of the stack member, and wherein the stack member includes the cam moving surface until the sheet is moved to the storage position, whereupon thereafter the sheet includes the cam moving surface.

32. An automated banking machine apparatus comprising:

a generally cylindrical flipper member including an arcuate extending slot, wherein the slot terminates inwardly at an inward portion, the flipper member further including a radially extending recess and a flexible flap in operative connection with the flipper member;

a gripper member rotationally mounted in supporting connection with the flipper member, wherein the gripper member is movable in the recess between a first position, wherein in the first position a sheet in the slot is held in fixed engagement with the flipper member, and a second position wherein a sheet is movable relative to the flipper member in the slot;

a moving mechanism, wherein the moving mechanism is operative to rotate the flipper member about an axis;

a stop surface extending adjacent to the flipper member, wherein a projection of the stop surface intersects the inward portion of the slot in a releasing rotational position of the flipper member;

a releasing mechanism, wherein the releasing mechanism is operative to move the gripper member from the first position to the second position when the flipper member is adjacent to the releasing position;

a stack member adjacent the flipper member and extending in a direction generally normal of the stop surface, wherein upon rotation of the flipper member to the releasing position the sheet is moved to a storage position intermediate of the flipper member and of the stack member and the flap engages the sheet in the storage position.

33. An automated banking machine apparatus comprising:

a rotatable member including a movable gripper member mounted in supporting connection therewith, wherein the gripper member is in operative connection with a movable engaging portion, and wherein movement of the moveable engaging portion is operative to cause the gripper member to selectively engage a sheet in relatively fixed engagement with the rotatable member in a first rotational position of the rotatable member, and release a sheet from relatively fixed engagement with the rotatable member in a second rotational position angularly disposed from the first rotational position;

a sheet guide, wherein the sheet guide is operative to guide the sheet to engage the gripper member when the rotatable member is in the first rotational position;

a stop surface adjacent the rotatable member, wherein the stop surface is operative to engage the sheet in engagement with the rotatable member in a second rotational position of the rotatable member, wherein engagement with the stop surface is operative to urge the sheet to disengage from relatively fixed engagement with the rotatable member, and wherein after such disengagement the sheet is operative to engage the movable engaging portion, and to cause the gripper member to move to engage a further sheet when the rotatable member is in the first rotational position.

34. The apparatus according to claim 33 wherein the stop surface extends generally along a first direction, and further comprising a stack member movable generally along the first direction relative to the stop surface, and further comprising a biasing member biasing the stack member along the first direction toward the rotatable member, wherein sheets disengaged from the rotatable member in the second rotational position are held in a storage position between the stack member and the rotatable member.

35. The apparatus according to claim 34 wherein the gripper member is pivotally mounted relative to the rotatable member, and wherein the engaging portion includes an outer gripper surface of the gripper member, wherein radial movement of the outer gripper surface relative to the rotatable member is operative to engage and release sheets relative to the rotatable member.

36. The apparatus according to claim 35 and further comprising a cam moving surface adjacent the rotatable member, wherein the engagement and disengagement of the outer gripper surface with the cam moving surface is operative to move the outer gripper surface radially to engage sheets.

37. The apparatus according to claim 33 wherein the rotatable member includes a cross sectional slot, wherein the slot includes an arcuately outward spiral portion, and wherein the gripper member is operative to engage sheets in the arcuately outward spiral portion of the slot.

38. An automated banking machine apparatus comprising:

a rotatable member including a gripper member pivotally moveably mounted in supporting connection therewith, wherein the gripper member includes an outer gripper surface thereon, and wherein radial movement of the outer gripper surface is operative to cause the gripper member to move to engage and release a sheet from relatively fixed engagement with the rotatable member;

a stop surface adjacent the rotatable member, wherein the stop surface is operative to engage a sheet that is in relatively fixed engagement with the rotatable member in a disengaging rotational position of the rotatable member, wherein engagement with the stop surface is operative to urge the sheet to disengage from relatively fixed engagement with the rotatable member and to cause the sheet to be placed in a storage position, wherein the sheet in the storage position includes a cam moving surface, and wherein engagement of the outer gripper surface with the cam moving surface is operative when the rotational member is in an engaging rotational position disposed from the disengaging rotational position, to cause the gripper member to move to engage a further sheet in relatively fix engagement with the rotatable member.

39. An automated banking machine apparatus comprising:

a rotatable member including a gripper member mounted in supporting connection therewith, wherein the gripper member is operative to selectively engage and release a sheet from relatively fixed engagement with the rotatable member;

a flexible flap in operative connection with the rotatable member;

a stop surface adjacent the rotatable member, wherein the stop surface is operative to engage a sheet in engagement with the rotatable member in a first rotational position of the rotatable member, wherein engagement with the stop surface is operative to urge the sheet to disengage from relatively fixed engagement with the rotatable member, and wherein the flap is operative to engage the disengaged sheet;

a sheet guide, wherein the sheet guide is operative to direct a sheet to engage the gripper member of the rotatable member in a second rotational position of the rotatable member angularly disposed from the first rotational position.

40. A method of operating an automated banking machine comprising:

(a) engaging an incoming sheet moving in a first direction in a sheet path in a peripherally extending slot in a rotating member, wherein the rotating member rotates about an axis extending generally perpendicular to the first direction, wherein the incoming sheet is engaged in a first rotational position of the rotating member;

(b) holding the sheet in the slot in relatively fixed engagement with the rotating member by radially moving relative to the axis a gripper portion in supporting connection with the rotating member, wherein the gripper portion moves in a radially extending recess that extends inward from an outer surface of the rotating member and generally perpendicular to the slot;

(c) rotating the rotating member with the incoming sheet engaged with the gripper portion, to a second rotational position, wherein in the second rotational position the incoming sheet is generally aligned with a stack;

(d) releasing the incoming sheet from relatively fixed engagement with the gripper portion in generally the second rotational position wherein the incoming sheet is included in the stack.

41. The method according to claim 40 and further comprising the step of engaging the sheet with a stop surface adjacent the second rotational position wherein engagement with the stop surface urges the incoming sheet to disengage from the gripper portion.

42. A method of operating an automated banking machine comprising:

(a) engaging a sheet moving in a sheet path with a flipper member, wherein the sheet is engaged in relatively fixed relation with the flipper member in a first rotational position of the flipper member responsive to a member portion in supporting connection with the flipper member being operatively engaged with a sheet supporting surface disposed from the sheet path;

(b) rotating the flipper member with the sheet in relatively fixed engagement therewith, in a rotational direction from the first rotational position to a second rotational position;

(c) engaging the sheet with a stop surface in the second rotational position to urge the sheet to release from relatively fixed engagement with the flipper member and into supporting connection with the sheet supporting surface; and (d) continuing to rotate the flipper member in the rotational direction after the sheet has been released therefrom to the first rotational position.

43. The method according to claim 42 and further comprising the step of:

(e) repeating steps (a) through (d), wherein a stack of sheets is formed by engagement of the sheets with the stop surface.

44. The method according to claim 42 wherein step (a) comprises moving a gripper member in supporting connection with the flipper member from a nonholding position wherein the sheet is not held in fixed relative engagement with the flipper member, to a holding position wherein the sheet is held in fixed relative engagement with the flipper member.

45. The method according to claim 44 wherein the step of moving the gripper member from the nonholding position to the holding position comprises moving an outer gripper surface of the gripper member radially inward relative to the flipper member.

46. The method according to claim 44 and generally concurrently with step (c) further comprising the step of:

(e) moving the gripper member from the holding position to the nonholding position.

47. The method according to claim 46 wherein in step (e) the movement of the gripper member from the holding position to the nonholding position includes moving an outer gripper activating surface radially outward relative to the flipper member.

48. The method according to claim 42 wherein the flipper member includes a peripherally extending slot, and wherein step (a) comprises directing an end of a sheet moving in a sheet path into the slot with a guide member.

49. A method of operating an automated banking machine comprising:

(a) engaging a first sheet moving in a sheet path with a flipper member by moving an outer gripper member surface of a gripper member radially inward by engagement with a second sheet in abutting relation with an adjacent stop surface, wherein the first sheet is engaged in relatively fixed relation with the flipper member in a first rotational position of the flipper member;

(b) rotating the flipper member with the first sheet in relatively fixed engagement therewith, in a rotational direction from the first rotational position to a second rotational position;

(c) engaging the first sheet with a stop surface in the second rotational position to release the first sheet from relatively fixed engagement with the flipper member; and (d) continuing to rotate the flipper member in the rotational direction after the first sheet has been released therefrom to the first rotational position.

50. A method of operating an automated banking machine comprising:

(a) engaging a sheet moving in a sheet path with a flipper member by moving a gripper member in supporting connection with the flipper member from a nonholding position to a holding position wherein the sheet is held in fixed relative engagement with the flipper member in a first rotational position of the flipper member;

(b) rotating the flipper member with the sheet in relatively fixed engagement therewith, in a rotational direction from the first rotational position to a second rotational position;

(c) engaging the sheet with a stop surface in the second rotational position to urge the sheet to release from relatively fixed engagement with the flipper member;

(d) generally during step (c), moving the gripper member from the holding position to the nonholding position responsive to moving an outer gripper activating surface of the gripper member radially outward relative to the flipper member responsive to disengaging from a surface of a further sheet in adjacent relation with the stop surface as the flipper member rotates in the rotational direction;

(e) continuing to rotate the flipper member in the rotational direction after the sheet has been released therefrom to the first rotational position.

51. A method of operating an automated banking machine comprising:

(a) engaging a sheet moving in a sheet path with a flipper member, wherein the sheet is engaged in relatively fixed relation with the flipper member in a first rotational position of the flipper member;

(b) rotating the flipper member with the sheet in relatively fixed engagement therewith, in a rotational direction from the first rotational position to a second rotational position;

(c) engaging the sheet with a stop surface in the second rotational position to release the sheet from relatively fixed engagement with the flipper member;

(d) engaging the sheet with a flexible flap operatively connected to the flipper member; and (e) continuing to rotate the flipper member in the rotational direction after the sheet has been released therefrom to the first rotational position.

52. A method of operating an automated banking machine comprising the steps of:

(a) engaging an incoming sheet moving in an incoming sheet path with a gripper portion in supporting connection with a rotating member wherein the incoming sheet is engaged in a first rotational position of the rotating member and wherein the gripper portion engages the sheet responsive to the gripper portion being operatively engaged with at least one sheet in a stack disposed from the sheet path;

(b) rotating the rotating member with the incoming sheet engaged with the gripper portion, to a second rotational position, wherein in the second rotational position the incoming sheet is generally aligned with the stack;

(c) releasing the incoming sheet from engagement with the gripper portion in generally the second rotational position, wherein the incoming sheet is included in the stack.

53. A method of operating an automated banking machine comprising:

a) engaging a sheet moving in a first direction in a sheet path with a sheet accepting slot in a flipper member, wherein the sheet is engaged in relatively fixed relation with the flipper member in a first rotational position of the flipper member by moving a gripper portion radially inward in a recess that extends in the flipper member generally perpendicular to the sheet accepting slot such that the gripper portion engages the sheet;

b) rotating the flipper member with the sheet in relatively fixed engagement therewith, in a rotational direction about an axis extending generally normal to the first direction, from the first rotational position to a second rotational position;

c) engaging the sheet with a stop surface in the second rotational position to urge the sheet to be released from relatively fixed engagement with the flipper member; and d) continuing to rotate the flipper member in the rotational direction after the sheet has been released therefrom to the first rotational position.

* * * * *